US006318832B1

(12) United States Patent
Bates et al.

(10) Patent No.: US 6,318,832 B1
(45) Date of Patent: Nov. 20, 2001

(54) HIGH RESOLUTION PRINTING

(75) Inventors: John Booth Bates, Lexington; Curt Paul Breswick, Georgetown, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/535,354

(22) Filed: Mar. 24, 2000

(51) Int. Cl.[7] ..... B41J 2/25
(52) U.S. Cl. ..... 347/15; 347/43
(58) Field of Search ..... 347/12, 15, 40, 347/41, 43; 358/1.2, 1.8

(56) References Cited

U.S. PATENT DOCUMENTS

| | | | | |
|---|---|---|---|---|
| 3,977,007 | | 8/1976 | Berry et al. | 347/15 |
| 4,575,730 | | 3/1986 | Logan et al. | 347/9 |
| 4,642,653 | * | 2/1987 | Ito et al. | 347/40 |
| 5,270,728 | | 12/1993 | Lund et al. | 347/5 |
| 5,321,432 | | 6/1994 | Ishikawa et al. | 347/131 |
| 5,359,355 | | 10/1994 | Nagoshi et al. | 347/9 |
| 5,416,612 | | 5/1995 | Ingraham et al. | 347/15 |
| 5,430,469 | | 7/1995 | Shioya et al. | 347/15 |
| 5,469,198 | | 11/1995 | Kadonaga | 347/41 |
| 5,500,661 | | 3/1996 | Matsubara et al. | 347/41 |
| 5,574,832 | | 11/1996 | Towery et al. | 347/40 |
| 5,583,550 | * | 12/1996 | Hickman et al. | 347/41 |
| 5,602,572 | | 2/1997 | Rylander | 347/15 |
| 5,642,142 | | 6/1997 | Bohorquez | 347/15 |
| 5,648,801 | | 7/1997 | Beardsley et al. | 347/15 |
| 5,675,365 | | 10/1997 | Becerra et al. | 347/9 |
| 5,677,714 | | 10/1997 | Klassen et al. | 347/9 |
| 5,696,542 | | 12/1997 | Matsubara et al. | 347/2 |
| 5,719,601 | | 2/1998 | Moore et al. | 347/15 |
| 5,731,827 | * | 3/1998 | Mantell et al. | 347/40 |
| 5,742,300 | | 4/1998 | Klassen | 347/9 |
| 5,754,192 | | 5/1998 | Sugaya | 347/15 |
| 5,767,870 | | 6/1998 | Klassen et al. | 347/9 |
| 5,818,488 | | 11/1998 | Tanuma et al. | 347/130 |

FOREIGN PATENT DOCUMENTS

| | | |
|---|---|---|
| 0 516 420 B1 | 8/1996 | (EP) . |
| 0 556 959 B1 | 7/1998 | (EP) . |

* cited by examiner

*Primary Examiner*—N. Le
*Assistant Examiner*—Lamson D. Nguyen
(74) *Attorney, Agent, or Firm*—John Victor Pezdek; Michael T. Sanderson; Mark P. Crockett

(57) ABSTRACT

An ink jet printer receives image data defining a pattern of dots in a non-square rectangular grid and prints the pattern of dots on a print medium based on the image data. The pattern of dots consists of at least four interlaced checkerboard arrays of dots printed in four passes of the print head across the print medium, where each one of the four checkerboard arrays is printed during a different one of the four passes. Each of the checkerboard arrays is offset from the other checkerboard arrays by a predetermined spacing in at least one of the first and second directions. The printer prints the second checkerboard array horizontally offset from the first checkerboard array by a distance substantially equivalent to $^{5d}/_{4}$, where d is the diameter of the printed dots. The printer prints the third checkerboard array vertically offset from the second checkerboard array by a distance substantially equivalent to $^{-d}/_{2}$ and horizontally offset by a distance substantially equivalent to $^{-3d}/_{4}$. The printer prints the fourth checkerboard array horizontally offset from the third checkerboard array by a distance substantially equivalent to $^{-3d}/_{4}$. This dot placement method optimally covers a grid having a resolution of $^{4}/_{d}\times^{2}/_{d}$ dpi with dots having diameters that are much larger than optimal for the resolution of the grid. Thus, the invention avoids excessive dot overlap which could lead to ink saturation of the print medium.

18 Claims, 19 Drawing Sheets

HIGH RESOLUTION PRINTING

FIELD OF THE INVENTION

The present invention is generally directed to forming images consisting of patterns of dots. The invention is more particularly directed to high-resolution inkjet printing based on multiple interlaced patterns of dots.

BACKGROUND OF THE INVENTION

An inkjet printer forms an image on a print medium by placing a pattern of dots on the medium. Possible dot locations are represented by an array or grid of pixels that are arranged in a rectilinear array of rows and columns. The center-to-center distance between pixels, or dot pitch, is determined by the resolution of the printer. For example, for a printer capable of printing 300 dots per inch (dpi), the dot pitch of the array is 1/300 of an inch.

The quality of printed images produced by an inkjet printer depends in part on the resolution of the printer. Typically, higher or finer resolutions, where the printed dots are more closely spaced, results in higher quality images. Increasing the resolution of an inkjet printer increases the number of dots to be printed in a unit area by the product of the increase factor in each dimension in the grid. For example, doubling the print resolution from 300 to 600 dpi in a square grid results in four times as many dots per unit area. Consequently, without a decrease in dot size, four times as much ink would be printed in the same area. If too much ink is printed in a given area, the print medium can become saturated. Ink saturation can cause smudging and wrinkling of the medium.

One way to avoid saturating a print medium when printing dots that are larger than optimal for the grid resolution is to reduce the size of each dot. However, significant reductions in dot size may be extremely difficult, if not impractical, to achieve.

Addressing and placing a dot of ink at every pixel location in a high-resolution grid requires many redundant nozzles, very slow print head travel across the medium, or very high firing frequency. With each of these options there is either increased cost, slowed performance, or difficult technical challenges.

Therefore a method of printing is needed that provides high-resolution printing using a dot size that is larger than optimal for the grid resolution, while avoiding ink saturation of the print medium.

Further, true high-resolution printing involves large amounts of image data. For example, 1200×1200 dpi printing involves four times as much data as 600×600 dpi printing. The standard parallel port interface between a host computer and a printer can become a data bottleneck when transferring high-resolution print data to the printer. Faster and more efficient methods of transferring print data from the host computer to the printer are needed.

SUMMARY OF THE INVENTION

The foregoing and other needs are met by an ink jet printer that receives image data defining a pattern of dots in a rectangular grid and that prints the pattern of dots on a print medium based on the image data. The printer includes a print medium advance mechanism for advancing the print medium in a first direction. The printer also includes a print head having multiple nozzles for ejecting ink droplets onto the print medium to print the dots. The center-to-center spacing in the first direction between the nozzles is represented by d. A carriage connected to the print head moves the print head adjacent the print medium in a second direction which is perpendicular to the first direction. A carriage drive mechanism connected to the carriage drives the carriage in the second direction. A printer controller is electrically connected to the print head, the print medium advance mechanism, and the carriage drive mechanism. The controller controls the print head to eject ink droplets from the nozzles toward the print medium, controls the print medium advance mechanism to advance the print medium in the first direction, and controls the carriage drive mechanism to move the carriage in the second direction. The ejection of ink droplets, advancement of the print medium, and movement of the carriage under control of the printer controller forms the pattern of dots on the medium consisting of at least four interlaced arrays of dots. Each of the arrays is offset from the other arrays by a predetermined spacing in at least one of the first and second directions.

In preferred embodiments of the invention, the printer prints four interlaced checkerboard arrays of dots in four passes of the print head in the second direction across the print medium, where each one of the four checkerboard arrays is printed during a different one of the four passes. In some preferred embodiments, the printer prints the second checkerboard array offset from the first checkerboard array in the second direction by a distance substantially equivalent to $^{+b}$ $^{5d}/_{4}$. The printer prints the third checkerboard array offset from the second checkerboard array in the first direction by a distance substantially equivalent to $^{-d}/_{2}$ and in the second direction by a distance substantially equivalent to $^{-+b}$ $_{3d}/_{4}$, and prints the fourth checkerboard array offset from the third checkerboard array in the second direction by a distance substantially equivalent to $^{-+b}$ $^{3d}/_{4}$.

This dot placement method optimally covers a grid having a resolution of $^{4}/_{d}$×$^{2}/_{d}$ dpi with dots having diameters that are much larger than optimal for the resolution of the grid. Thus, the invention avoids excessive dot overlap which could lead to ink saturation of the print medium.

In other preferred embodiments of the invention, the printer prints the pattern of dots consisting of first, second, third, and fourth interlaced arrays of dots. Each of the arrays has parallel columns of dots aligned in the first direction and parallel rows of dots aligned in the second direction. Adjacent dots in each column have a center-to-center spacing in the first direction substantially equivalent to d, and adjacent dots in each row have a center-to-center spacing in the second direction substantially equivalent to d. The second array of dots is offset from the first array in the first and second directions by a distance substantially equivalent to $^{d}/_{2}$. The third array is offset from the second array in the first direction by a distance substantially equivalent to $^{d}/_{2}$. The fourth array is offset from the third array in the first and second directions by a distance substantially equivalent to $^{d}/_{2}$.

BRIEF DESCRIPTION OF THE DRAWINGS

Further advantages of the invention will become apparent by reference to the detailed description of preferred embodiments when considered in conjunction with the drawings, which are not to scale herein like reference characters designate like or similar elements throughout the several drawings as follows.

DETAILED DESCRIPTION OF THE INVENTION

Figure 1:
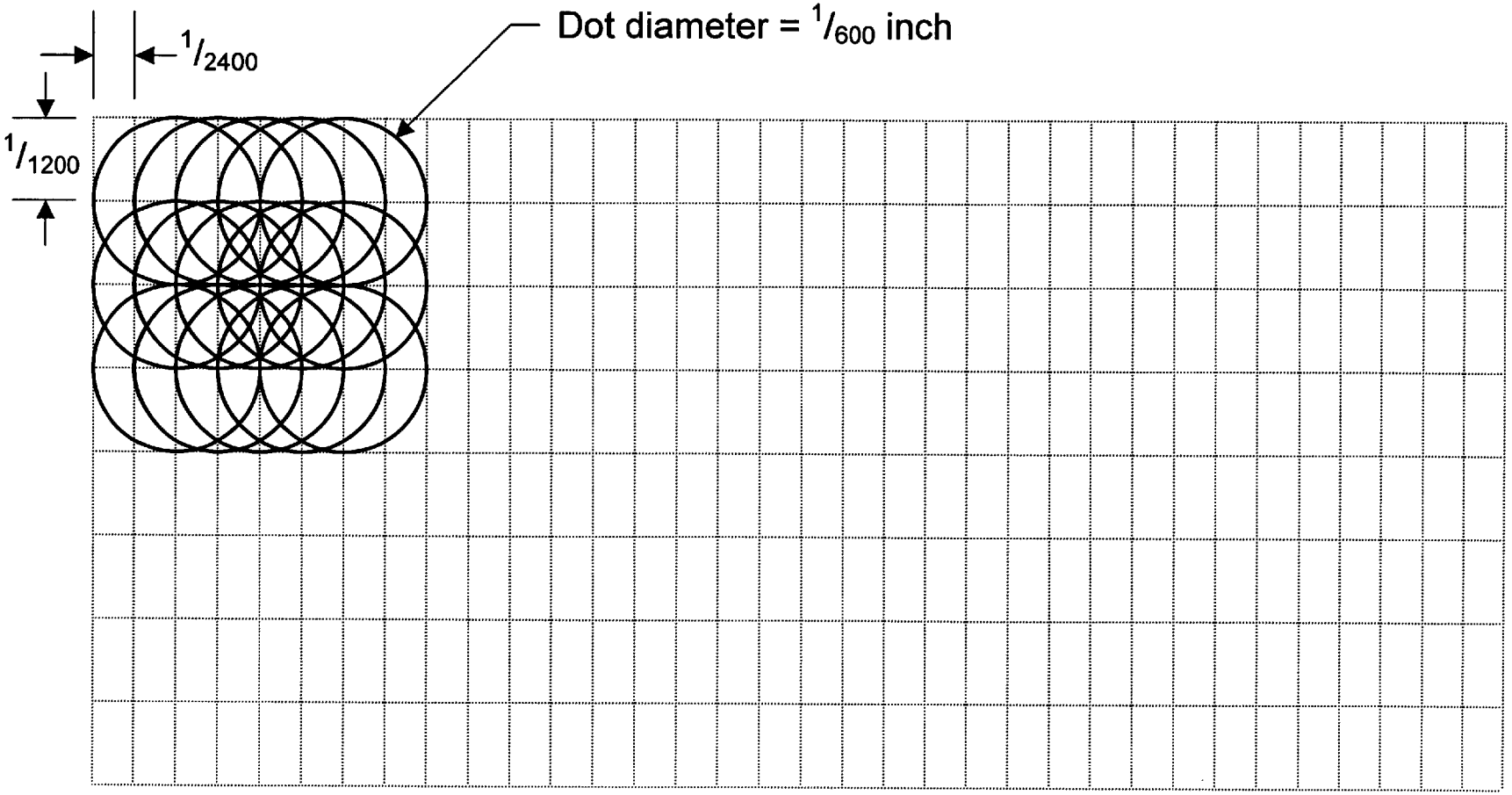
FIG. 1 depicts excessive dot overlap resulting from printing dots that are larger than optimal at every pixel location in a non-square grid.

FIG. 1 depicts a non-square rectangular grid having a horizontal resolution of 1/2400 of an inch and a vertical resolution of 1/1200 of an inch. If dots having 1/600 inch diameter were placed at each pixel location in the grid, the resulting dot coverage would be as shown in the upper left corner of the grid. Obviously, dots having such large diameter printed at each pixel location results in excessive dot overlap. Excessive dot overlap leads to ink saturation of the print medium.

Figure 2:
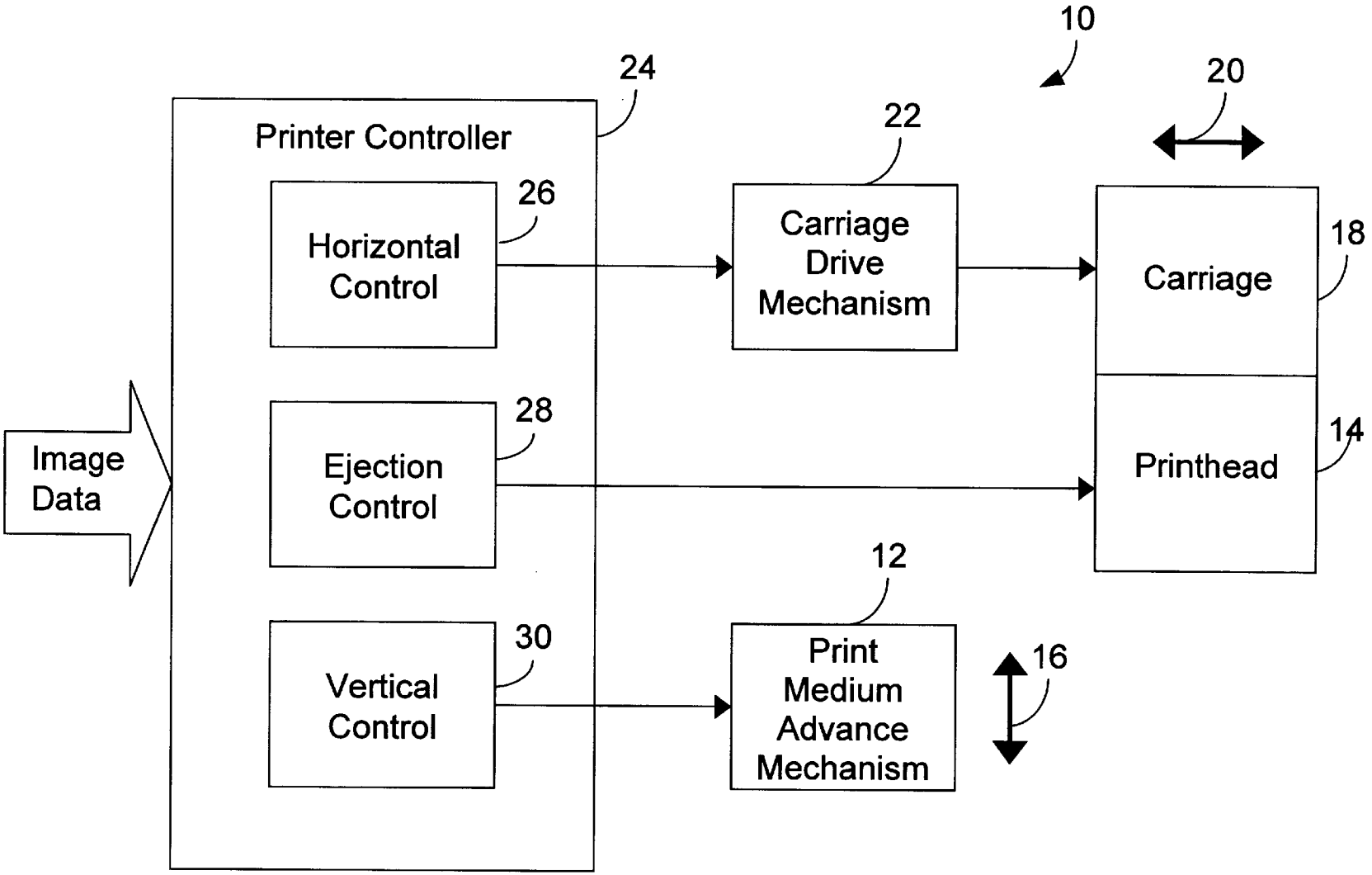
FIG. 2 is a functional block diagram of an inkjet printer according to a preferred embodiment of the invention.

Shown in FIG. 2 is a functional block diagram of a preferred embodiment of a printer 10 that eliminates excessive dot overlap while still providing 2400×1200 dpi addressability. The printer 10 includes a print medium advance mechanism 12 for advancing a print medium, such as paper, relative to a print head 14. Preferably, the print medium advance mechanism 12 includes a motor that mechanically drives a roller to cause a sheet of paper to move in the direction indicated by the arrow 16. Hereinafter, the direction indicated by the arrow 16 is referred to as a first or vertical direction. The print head 14 includes an array of nozzles for ejecting droplets of ink onto the print medium. Each droplet of ink forms a dot on the medium having a diameter d. The printer 10 also includes a carriage 18 that is mechanically connected to the print head 14 for providing movement of the print head 14 adjacent the print medium. Preferably, the carriage 18 rides along a rail in the direction indicated by the arrow 20. Hereinafter, the direction indicated by the arrow 20 is referred to as a second or horizontal direction. A carriage drive mechanism 22 is mechanically coupled to the carriage 18 for driving the carriage 18 in the horizontal direction.

With continued reference to FIG. 2, the printer 10 includes a printer controller 24. The printer controller 24 is preferably a digital microcontroller that receives image data from a computer and generates printer drive signals based on the image data. The printer controller 24 includes a horizontal control module 26, an ejection control module 28, and a vertical control module 30. As described in greater detail hereinafter, the horizontal control module 26 generates drive signals to control the carriage drive mechanism 22, the ejection control module 28 generates drive signals to control ejection of ink droplets from the nozzles in the print head 14, and the vertical control module 30 generates drive signals to control the print medium advance mechanism 12, where the drive signals are based on the image data.

Figure 3:
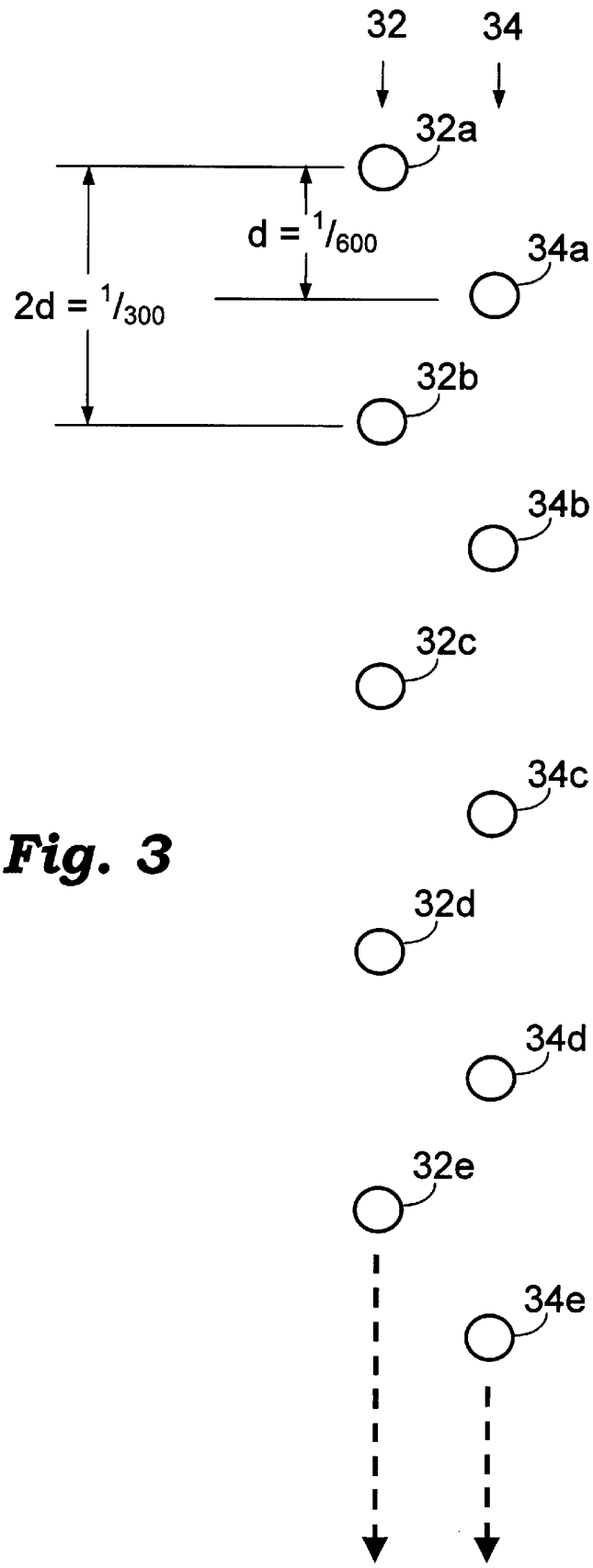
FIG. 3 depicts an inkjet nozzle array according to a preferred embodiment of the invention.

FIG. 3 depicts a portion of the nozzle array on the print head 14. The array consists of two columns of nozzles 32 and 34, with a vertical nozzle-to-nozzle spacing in each column of substantially equivalent to twice the drop diameter, or 2*d*. In the preferred embodiment of the invention, the vertical nozzle-to-nozzle spacing 2*d* is 1/300 inch. Column 34 is vertically offset from column 32 by half the nozzle-to-nozzle spacing, which is substantially equivalent to the drop diameter d. In the preferred embodiment of the invention, the vertical offset between the columns 32 and 34 is 1/600 inch. As shown in FIG. 3, the nozzles of column 32 are referred to as nozzle 32*a*, nozzle 32*b*, nozzle 32*c*, etc., and the nozzles of column 34 are referred to as nozzle 34*a*, nozzle 34*b*, nozzle 34*c*, etc. The nozzles of a first embodiment described herein produce printed dots having diameters d of 1/600 inch.

Figure 4:
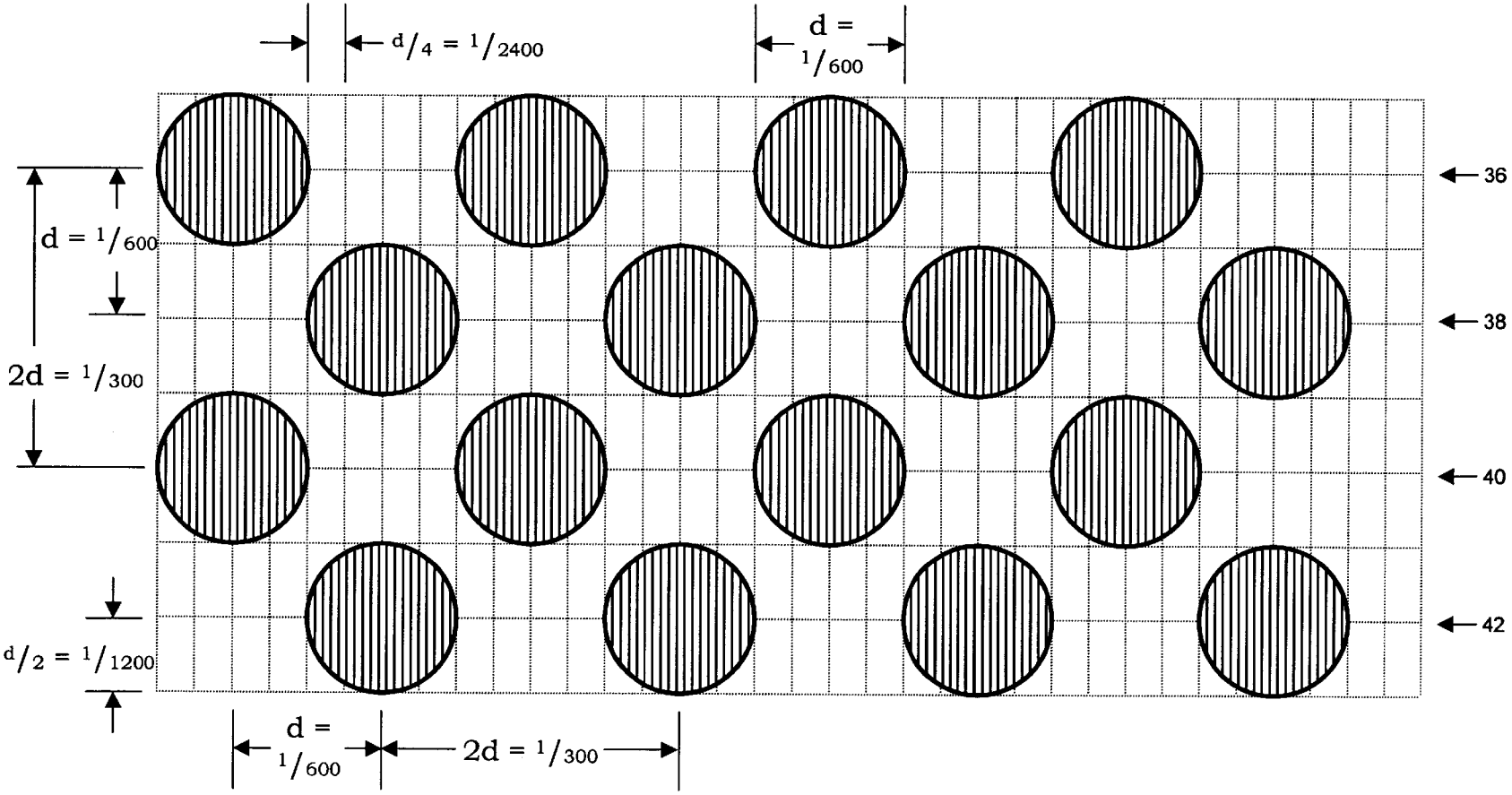
FIG. 4 depicts a first checkerboard pattern of dots printed according to a first embodiment of the invention.

With reference now to FIGS. 4–7, a method of printing an image according to a first embodiment of the invention to completely cover a 4/d×2/d dpi grid using the printer 10 is described. Preferably, the image is printed in four passes of the print head 14 across the print medium. Shown in FIG. 4 is a first checkerboard pattern of dots printed by the printer 10 during a first of the four passes. As the carriage 18 and the carriage drive mechanism 22 move the print head 14 horizontally across the print medium (FIG. 2), the nozzle 32*a* prints the uppermost row of dots 36, the nozzle 34*a* prints the row 38, the nozzle 32*b* prints the row 40, and the nozzle 34*b* prints the row 42. The dot-to-dot spacing within each row is 2*d*, which in the preferred embodiment is 1/300 inch. The vertical spacing between rows is equivalent to d, which is preferably 1/600 inch.

Figure 5:
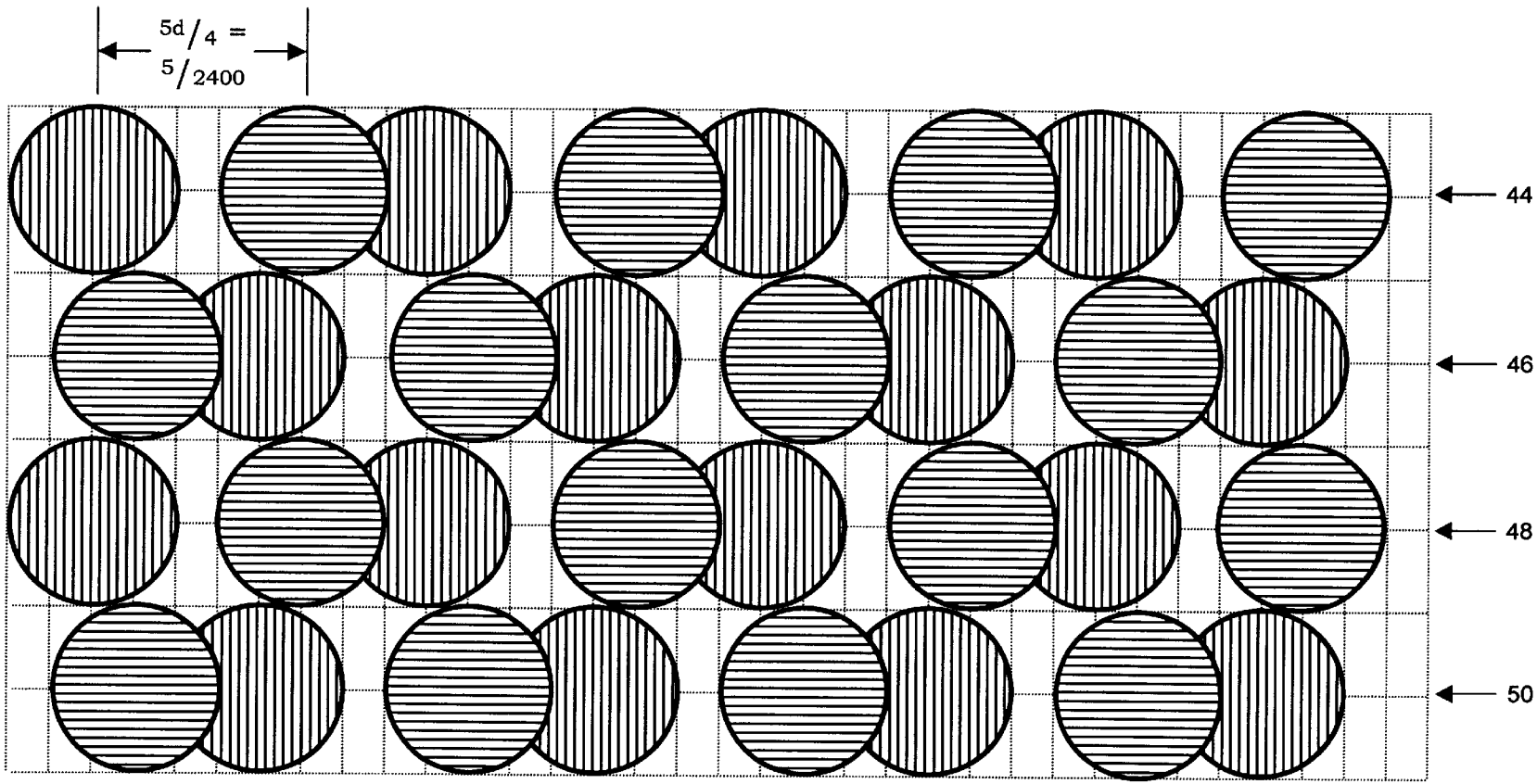
FIG. 5 depicts first and second checkerboard patterns of dots printed according to the first embodiment the invention.

FIG. 5 shows the image as it would appear after the second pass. The horizontally-hatched dots represent a second checkerboard pattern printed by the printer 10 during the second pass. During this second pass, the nozzle 32*a* prints the row 44, the nozzle 34*a* prints the row 46, the nozzle 32*b* prints the row 48, and the nozzle 34*b* prints the row 50. As FIG. 5 indicates the second checkerboard pattern is offset to the right in the second direction (horizontally) by $^{+b}$ $^{5d}/_{4}$ relative to the first checkerboard pattern. For purposes of this description, an offset to the right is a positive offset, while an offset to the left is a negative offset. In the preferred embodiment of the invention, this horizontal offset is $5/2400$ inch. The second checkerboard pattern of dots has the same horizontal dot-to-dot spacing within each row, and the same vertical spacing between each row as the first checkerboard pattern. After printing this second pass, the print medium advance mechanism 12 advances the print medium vertically by $d/2$, which is preferably $1/1200$ inch, and the printer 10 prints the third pass.

Figure 6:
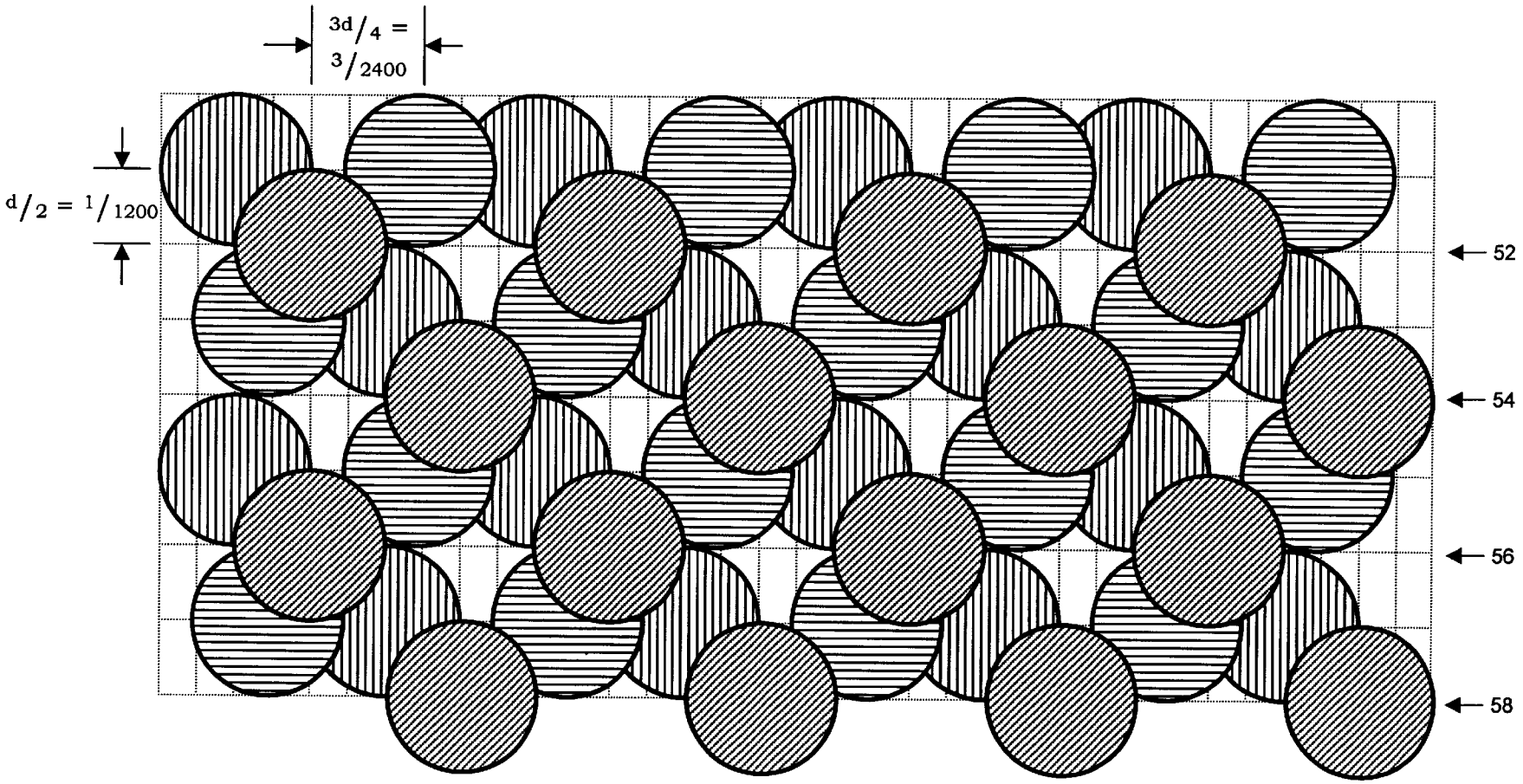
FIG. 6 depicts first, second, and third checkerboard patterns of dots printed according to the first embodiment of the invention.

FIG. 6 shows the image as it would appear after the third pass. The diagonally-hatched dots represent a third checkerboard pattern printed by the printer 10 during the third pass. During this third pass, the nozzle 32*a* prints the row 52, the nozzle 34*a* prints the row 54, the nozzle 32*b* prints the row 56, and the nozzle 34*b* prints the row 58. As shown in FIG. 6, the third checkerboard pattern is offset in the second direction (horizontally) by $^{-+b}\ 3d/4$ and in the first direction (vertically) by $^{-}d/2$ relative to the second checkerboard pattern. For purposes of this description, a downward vertical offset is a negative offset, while an upward vertical offset is a positive offset. In the preferred embodiment, $^{+b}\ 3d/4=3/2400$ inch and $d/2=1/1200$ inch. The third checkerboard pattern of dots has the same horizontal dot-to-dot spacing within each row, and the same vertical spacing between each row as the first and second checkerboard patterns.

Figure 7:
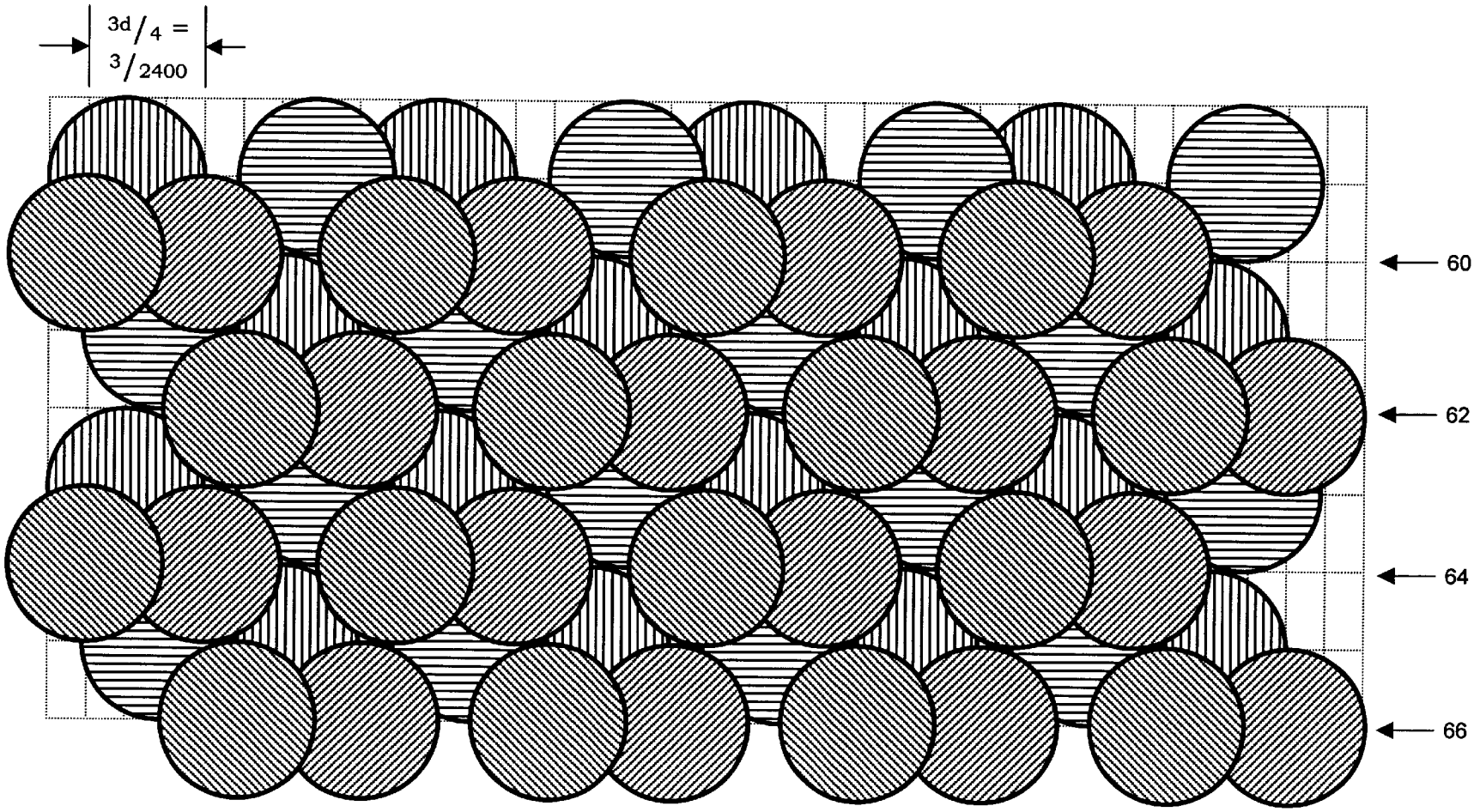
FIG. 7 depicts first, second, third, and fourth checkerboard patterns of dots printed according to first embodiment of the invention.

FIG. 7 shows the image as it would appear after the fourth pass. The uppermost layer of diagonally-hatched dots represent a fourth checkerboard pattern printed by the printer 10 during the fourth pass. During this fourth pass, the nozzle 32*a* prints the row 60, the nozzle 34*a* prints the row 62, the nozzle 32*b* prints the row 64, and the nozzle 34*b* prints the row 66. As shown in FIG. 7, the fourth checkerboard pattern is offset in the second direction (horizontally) by $^{-+b}\ 3d/4$ relative to the third checkerboard pattern. In the preferred embodiment, this horizontal offset is $3/2400$ inch. The fourth checkerboard pattern of dots has the same horizontal dot-to-dot spacing within each row, and the same vertical spacing between each row as the first, second, and third checkerboard patterns.

As FIGS. 4–7 indicate, the dot placement method according to the first embodiment of the invention optimally covers a grid having a resolution of $4/d \times 2/d$ dpi with dots of diameter d. These are dots that are much larger than optimal for the resolution of the grid. In placing the dots as described herein, the invention avoids excessive dot overlap which could lead to ink saturation of the print medium.

Another advantage of this first embodiment of the invention is a reduction in computational capacity needed to generate the image. Since many of the pixel locations in the grid are not used, there is no need for the printer controller 24 to calculate grid coordinates for those unused pixels.

Further, since the four layers of the image are printed in separate passes of the print head 14, the nozzle firing frequency need only accommodate a dot spacing of 2*d* ($1/300$ inch). Thus, the first embodiment of the invention increases the available firing window by a factor of four as compared to printing dots at a spacing of $d/2$ ($1/1200$ inch) in a single pass.

While the invention has been described thus far as applicable to printing $1/600$ inch diameter dots on a 1200×2400 dpi grid, it should be appreciated that the invention is not limited to those exemplary dimensions. The invention is applicable to any printing situation in which the dot diameter is larger than optimal for the grid resolution.

As FIG. 7 indicates, the first embodiment of the invention provides for placing the four checkerboard patterns of dots such that each of the checkerboard patterns is offset in the second direction (scan direction) by $d/4$ from each of the other three checkerboard patterns. Further, according to the invention, two of the checkerboard patterns are offset in the first direction (print medium advance direction) by an odd nonzero multiple of $d/2$ from the other two checkerboard patterns. Thus, when the four checkerboards are combined, as depicted in FIG. 7, a dot is printed in every $d/4$ column and in every $d/2$ row, thereby completely filling the grid.

A dot pattern equivalent to the one shown in FIG. 7 may also be attained by printing the first checkerboard pattern of dots as described above, printing the second checkerboard pattern so that it is horizontally offset relative to the first checkerboard pattern by $^{-+b}\ 3d/4$ (to the left), printing the third checkerboard pattern so that it is horizontally offset by $^{+b}\ 5d/4$ (to the right) and vertically offset by $^{-}d/2$ (downward) relative to the second checkerboard pattern, and printing the fourth checkerboard pattern so that it is horizontally offset from the third checkerboard pattern by $^{+b}\ 5d/4$ (to the right). One skilled in the art will appreciate that this method produces the same pattern of dots in an extended grid as the method described just previously.

It will also be appreciated that the invention is not limited by the order in which the four printing passes are made. The adjectives "first", "second", "third", and "fourth" are used herein to differentiate between the four arrays of dots in describing the printing process. These adjectives are not intended to indicate any particular temporal order in which the four passes are made to print the four arrays of dots. Thus, the four arrays of dots could be printed in any order to produce the pattern of dots shown in FIG. 7.

The apparatus and method described herein can be used in a printing process known in the art as "shingling". With "shingling", the printer 10 prints an image using multiple partially-overlapping passes of the print head 14, where none of the dots printed during a single pass overlap any other dot printed on the same pass. For example, consider a print head 14 having n number of nozzles, where n is an integer multiple of four that is greater than or equal to eight. With a spacing between nozzles in the first direction of d, the height of the nozzle array is nd. In an exemplary four-pass shingling process using this print head 14, after printing the first checkerboard pattern, the printer controller 24 commands the print medium advance mechanism 12 to advance the print medium in the first direction by one quarter of the height of the nozzle array, or $^{nd}/4$. The second checkerboard pattern is then printed as discussed above. After printing the second checkerboard pattern, the print medium is advanced in the first direction by $^{nd}/4-d/2$, and the third checkerboard pattern is printed as discussed above. After printing the third checkerboard pattern, the print medium is advanced in the first direction by $^{nd}/4$, and the fourth checkerboard pattern is printed as discussed above. After printing the fourth checkerboard pattern, the print medium is advanced in the first direction by $^{nd}/4+d/2$, and the first checkerboard is printed again. The process then repeats.

Figure 8:
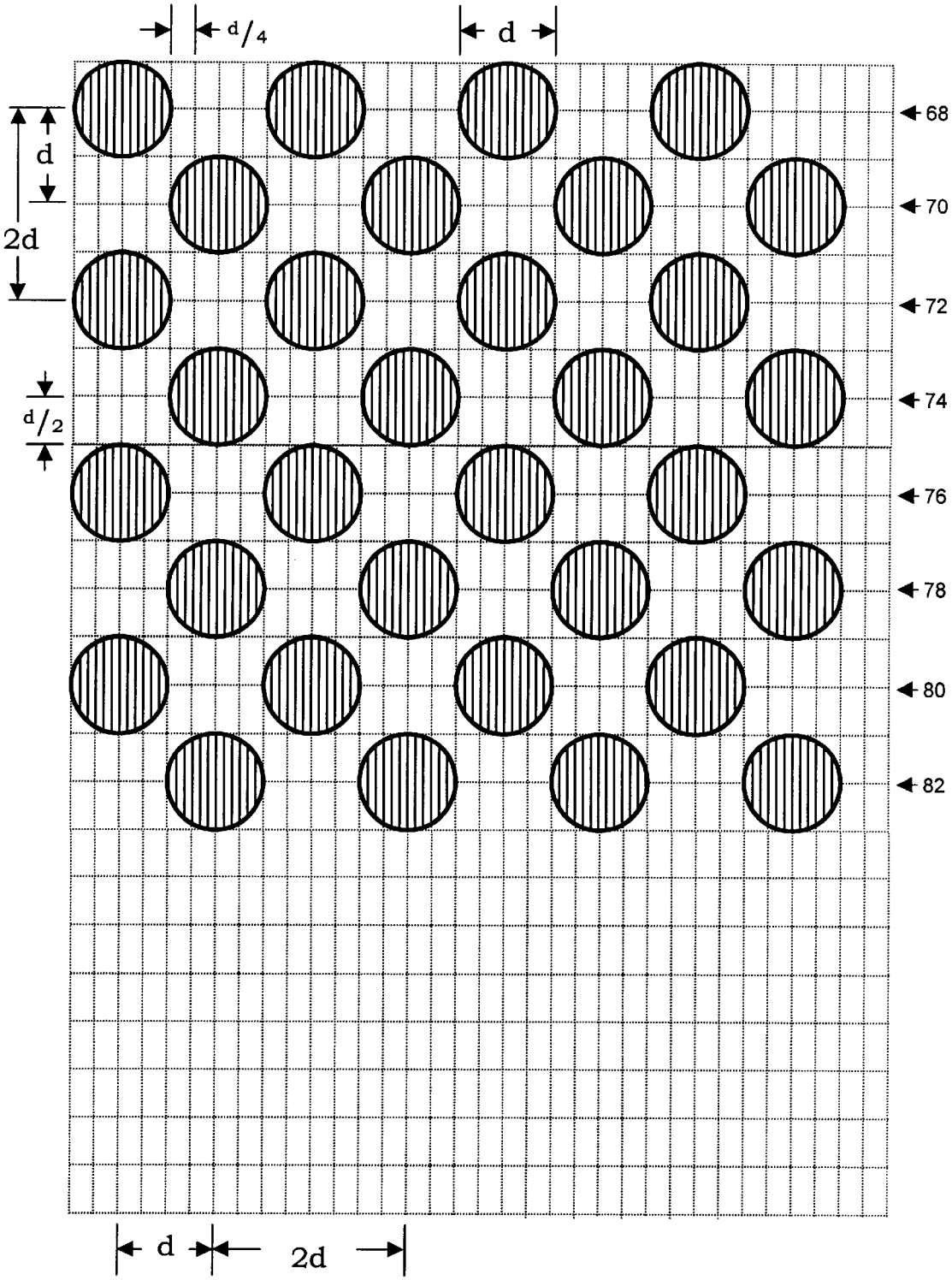
FIG. 8 depicts a first checkerboard pattern of dots printed by a shingling process according to the first embodiment of the invention.

The shingling process according to the first embodiment of the invention discussed above is now described in more detail with reference to FIGS. 8–11. For purposes of the following example, it will be assumed that the print head 14 has eight nozzles 32*a*–32*d* and 34*a*–34*d*, as shown in FIG. 3. FIG. 8 depicts a first checkerboard pattern of dots printed by the printer 10 during the first shingling pass. As the carriage 18 and the carriage drive mechanism 22 move the print head 14 horizontally across the print medium (FIG. 2), the nozzles 32*a*–32*d* print the rows of dots 68, 72, 76, and 80, and the nozzles 34*a*–34*d* print the rows 70, 74, 78, and 82. The print medium is then advanced in the first direction by one quarter of the height of the nozzle array, which in this example is 1/300 inch, and the second checkerboard pattern is printed.

Figure 9:
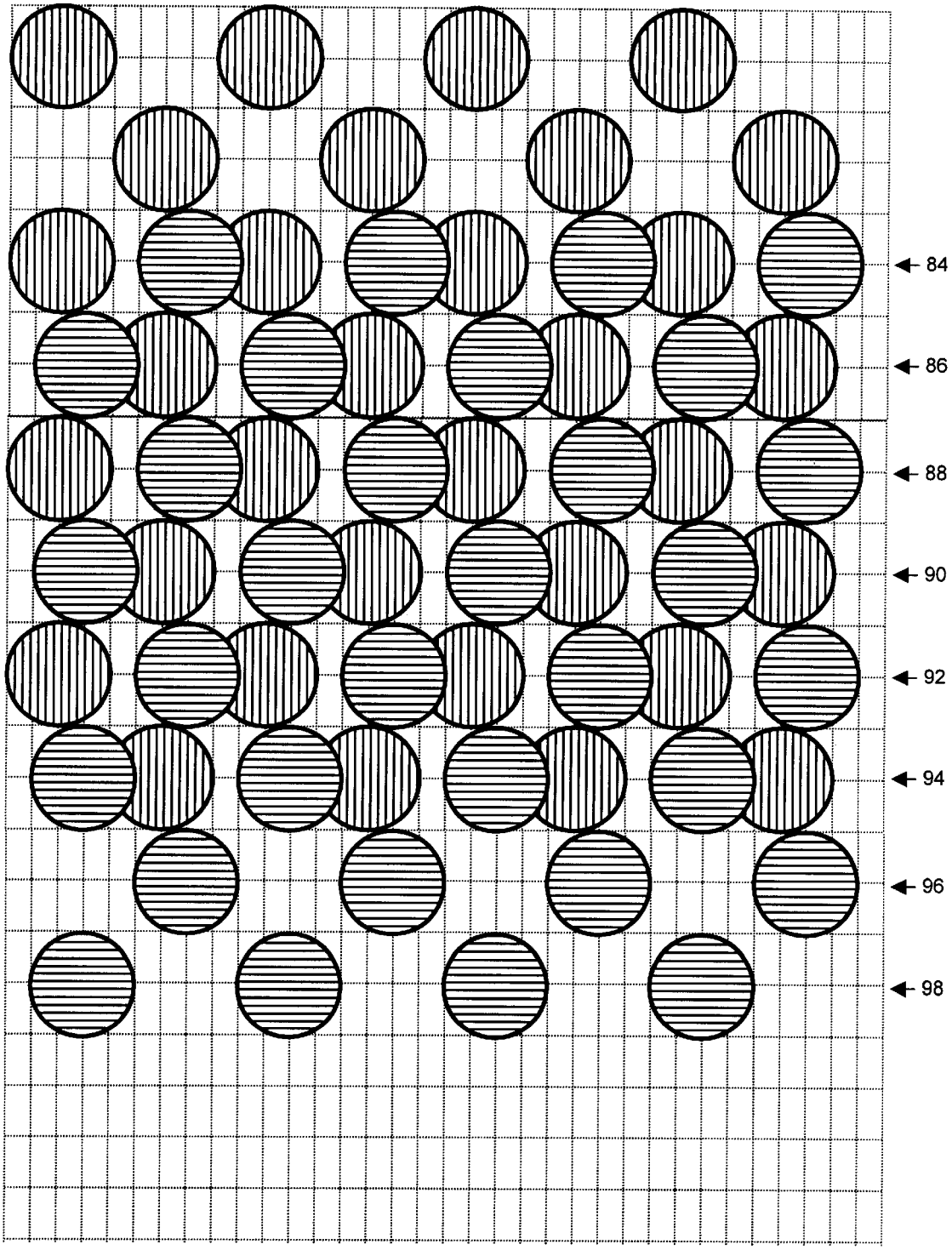
FIG. 9 depicts first and second checkerboard patterns of dots printed by a shingling process according to the first embodiment of the invention.

FIG. 9 shows the image as it would appear after the second shingling pass. The horizontally-hatched dots represent the second checkerboard pattern printed by the printer 10 during the second pass. During this second pass, the nozzles 32*a*–32*d* print the rows of dots 84, 88, 92, and 96, and the nozzles 34*a*–34*d* print the rows 86, 90, 94, and 98. After printing this second pass, the print medium advance mechanism 12 advances the print medium in the first direction by nd/4–d/2, which in this example is 1/300–1/1200=3/1200, and the printer 10 prints the third pass.

Figure 10:
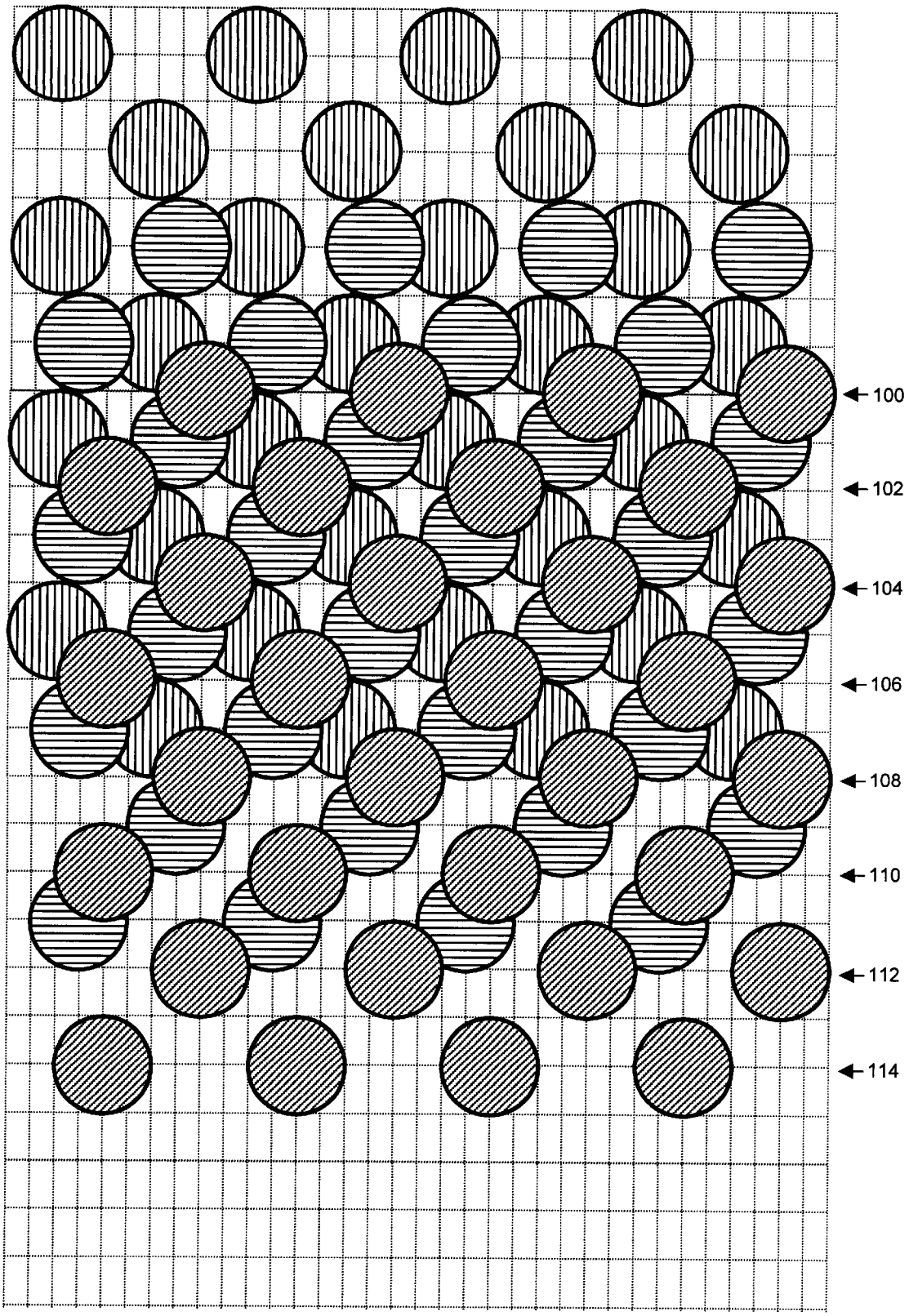
FIG. 10 depicts first, second, and third checkerboard patterns of dots printed by a shingling process according to the first embodiment of the invention.

FIG. 10 shows the image as it would appear after the third shingling pass. The diagonally-hatched dots represent the third checkerboard pattern printed by the printer 10 during the third pass. During this third pass, the nozzles 32*a*–32*d* print the rows of dots 100, 104, 108, and 112, and the nozzles 34*a*–34*d* print the rows 102, 104, 106, and 108. After printing the third pass, the print medium advance mechanism 12 advances the print medium in the first direction by nd/4, or 1/300 inch, and the printer 10 prints the fourth pass.

Figure 11:
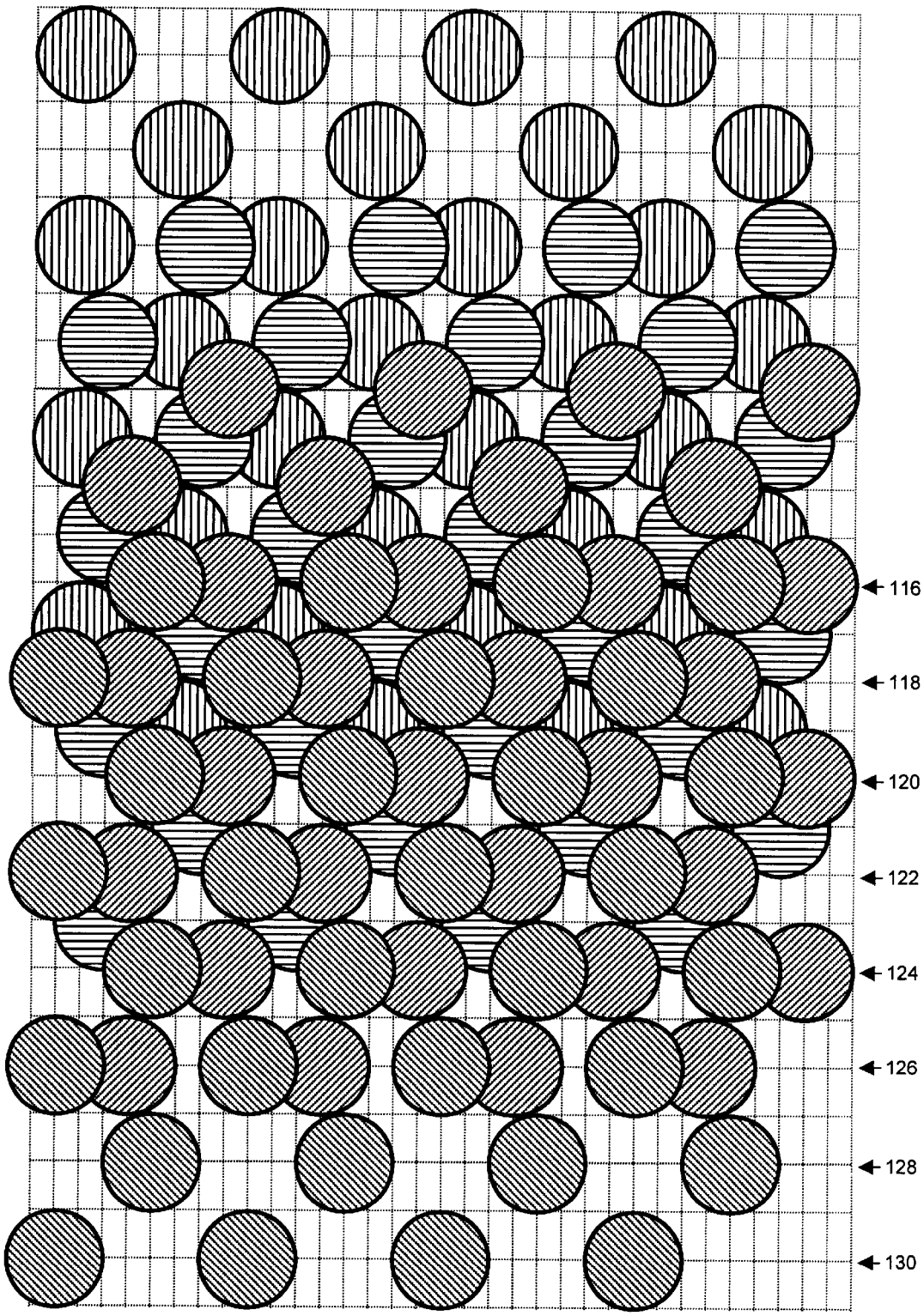
FIG. 11 depicts first, second, third, and fourth checkerboard patterns of dots printed by a shingling process according to the first embodiment of the invention.

FIG. 11 shows the image as it would appear after the fourth shingling pass. The uppermost layer of diagonally-hatched dots represent the fourth checkerboard pattern printed by the printer 10 during the fourth pass. During this fourth pass, the nozzles 32*a*–32*d* print the rows of dots 116, 120, 124, and 128, and the nozzles 34*a*–34*d* print the rows 118, 122, 126, and 130. It should be appreciated that, as the above-described process repeats, the dot pattern will continue to fill in as it appears between the rows 116 and 120 in FIG. 11.

A second embodiment of the invention provides a method of reducing the amount of print data that must be transferred from a host computer to a printer while printing an image. Consider a situation in which 1200×1200 dpi data is to be printed using a print head having a vertical center-to-center nozzle spacing of 1/600 inch, as depicted in FIG. 3. According to a prior method, the host computer sends the 1200×1200 dpi data to the printer in four portions of 1200 (horizontal)× 600 (vertical) dpi data, and the printer prints the data in four passes corresponding to the four portions of data. This scheme forces the vertical resolution to be 600 dpi to accommodate the vertical nozzle spacing.

Figure 12:
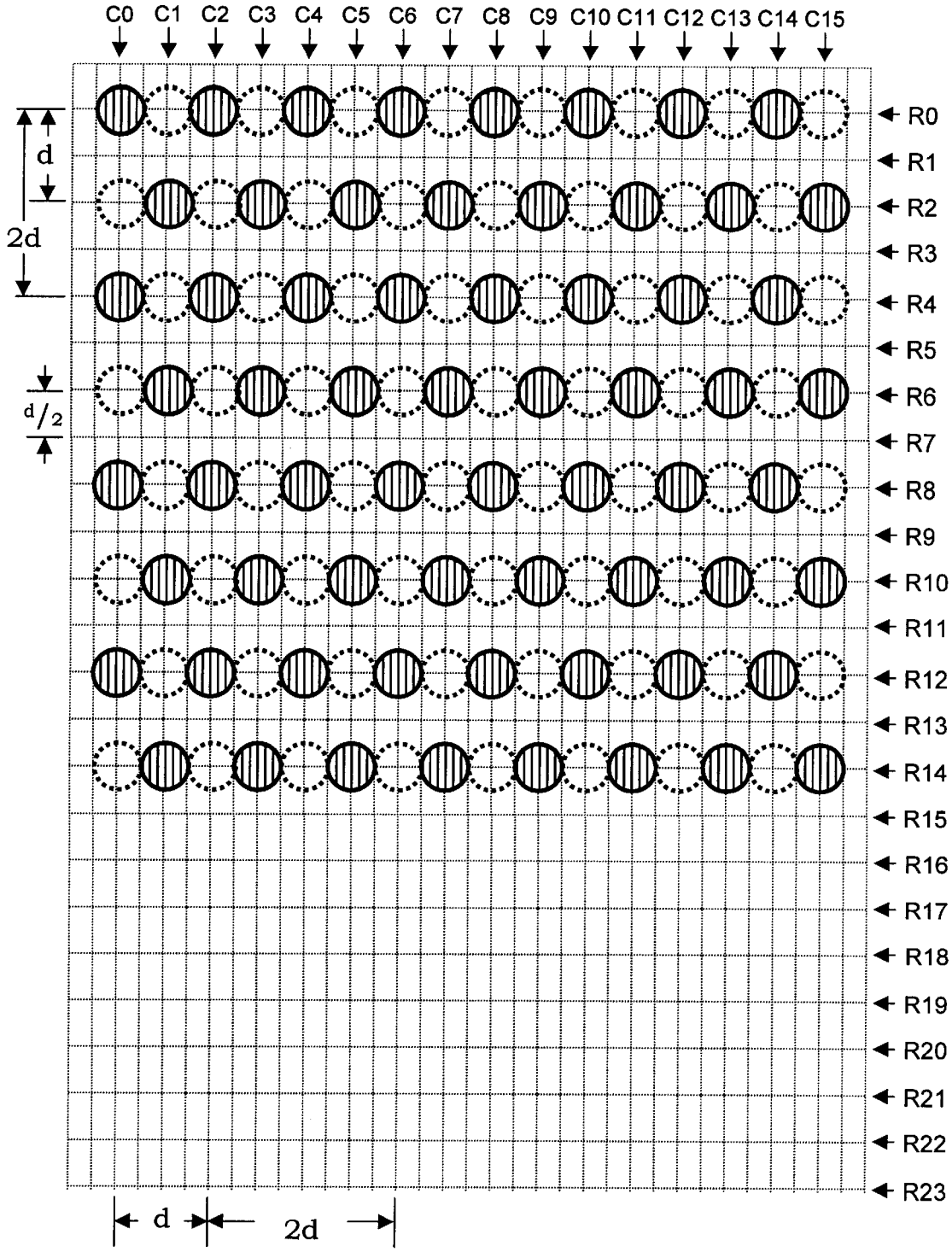
FIG. 12 depicts a first rectangular pattern of dots printed according to a prior method.

A prior method of shingled four-pass 1200×600 dpi printing is illustrated in the example of FIGS. 12–15. FIG. 12 depicts dots printed during a first pass of the print head. The circles having vertical hatching represent dots printed during the first pass. Since the data is shingled, dots are printed at alternating horizontal pixel locations. The circles having the dotted outlines represent pixel locations in the 1200×600 dpi data at which no dot is printed. Thus, as FIG. 12 illustrates, half of the print data sent from the host computer to the printer for the first pass represents non-printing or "off" pixels.

Figure 13:
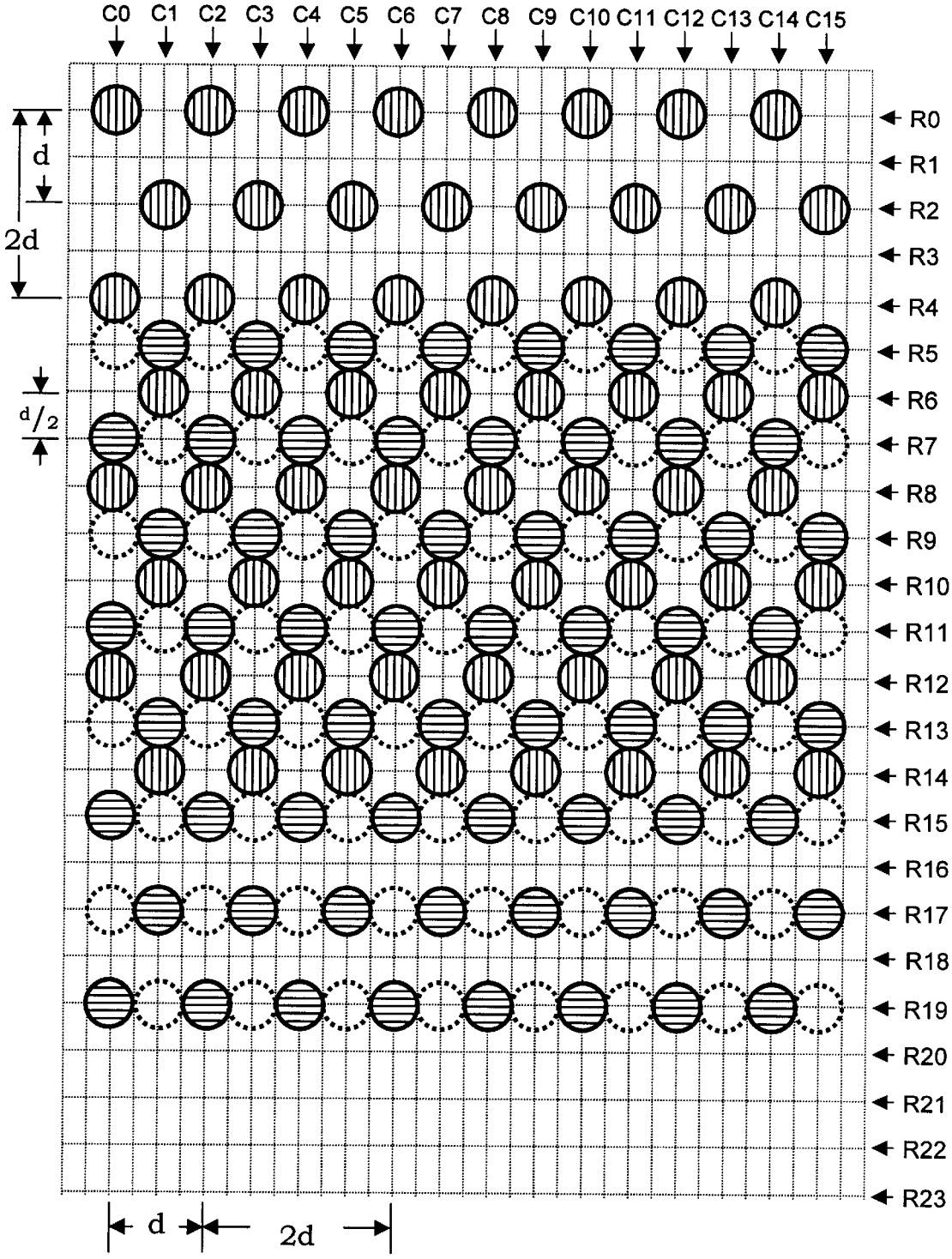
FIG. 13 depicts first and second rectangular patterns of dots printed according to a prior method.

FIG. 13 depicts the appearance of the image printed using the prior method after a second pass of 1200×600 dpi data. The circles having horizontal hatching represent dots printed during the second pass. The dotted outline circles of FIG. 13 represent non-printing pixel locations in the second pass. Note that the print medium has advanced by one-quarter of the height of the nozzle array before printing the second pass.

Figure 14:
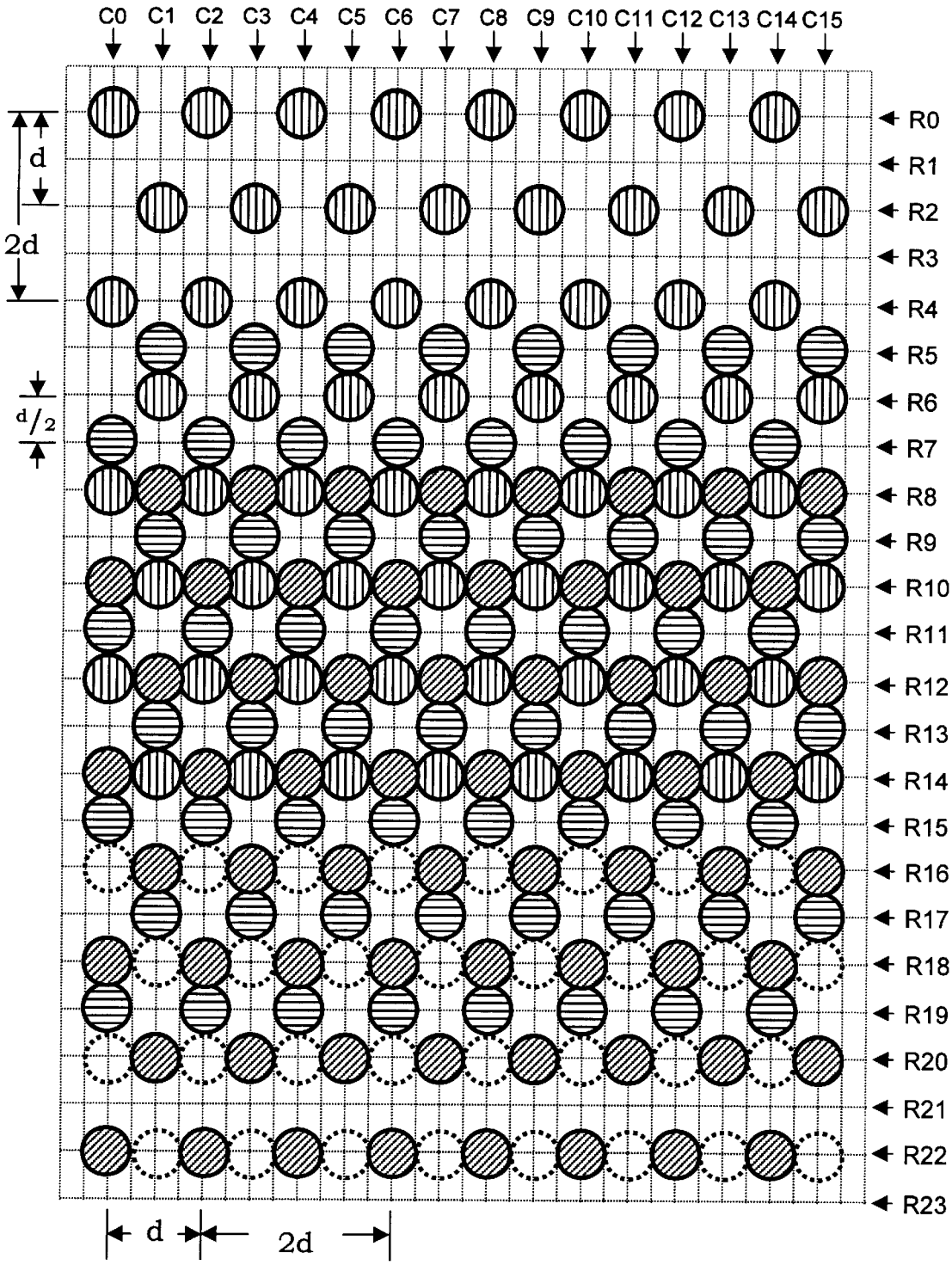
FIG. 14 depicts first, second, and third rectangular patterns of dots printed according to a prior method.
Figure 15:
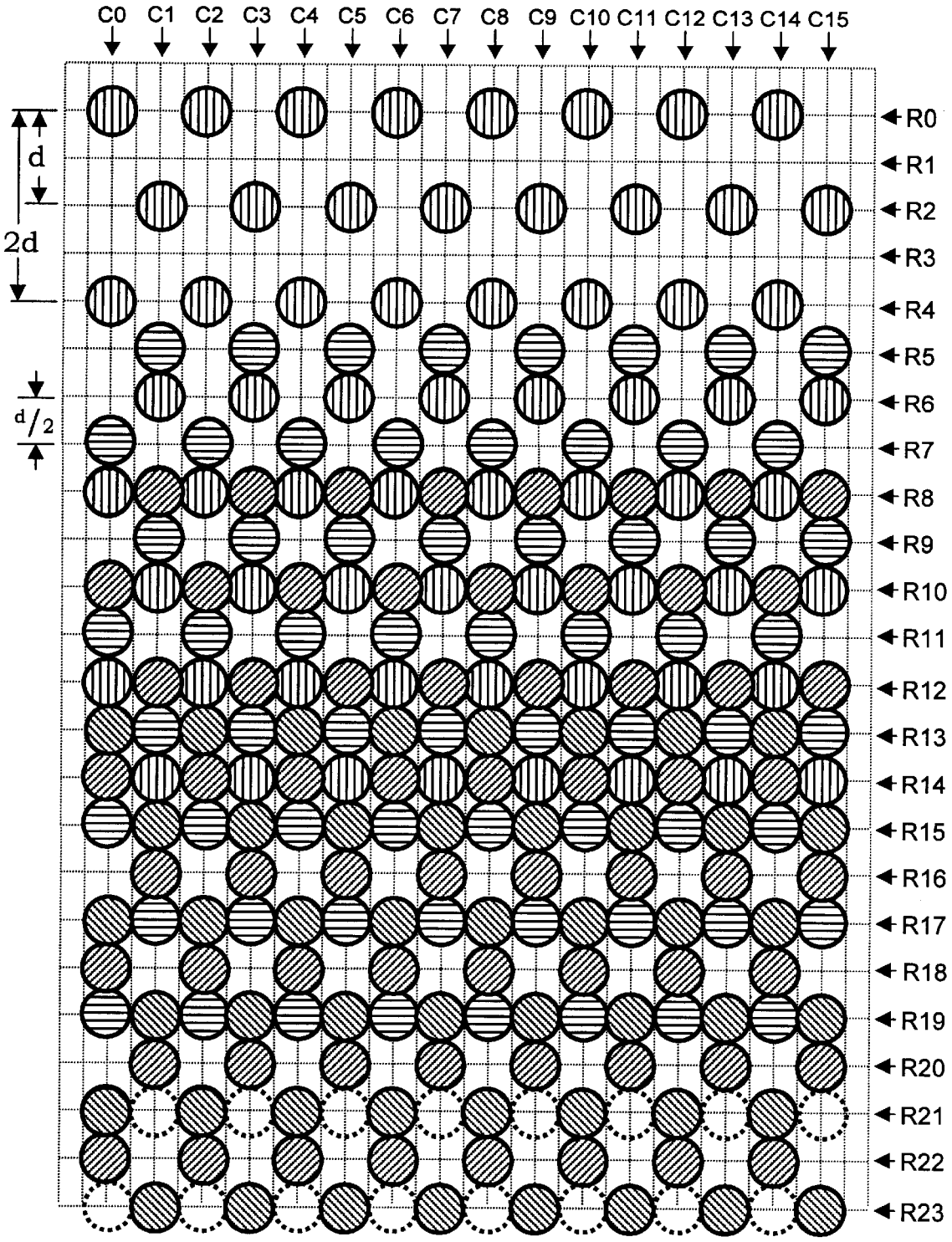
FIG. 15 depicts first, second, third, and fourth rectangular patterns of dots printed according to a prior method.

FIGS. 14 and 15 depict the appearance of the image printed using the prior method after a third and a fourth pass, respectively, of 1200×600 dpi data. The circles having diagonal hatching represent dots printed during the third and fourth passes. Again, half of the pixels in each pass are non-printing pixels as represented by the dotted outline circles.

Thus, due to the non-printing pixel locations, this prior method of printing requires transferring twice as much data to the printer than is necessary to represent the printing pixel locations. As described below, the second embodiment of the invention cuts the amount of data in half by eliminating the data representing the non-printing pixel locations.

Figure 16:
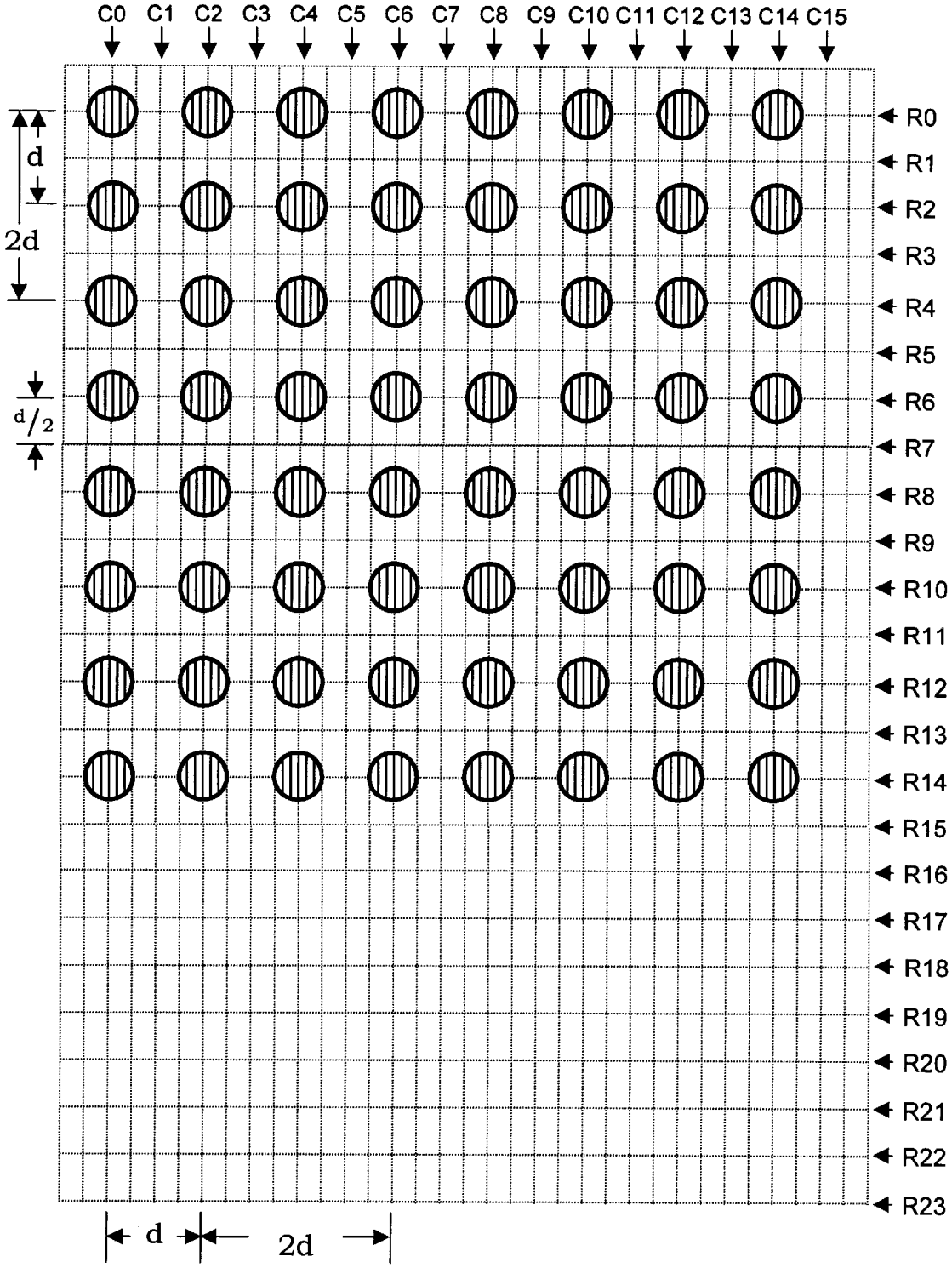
FIG. 16 depicts a first rectangular pattern of dots printed according to a second embodiment of the invention.

A print data formatting and printing method according to the second embodiment of the invention is illustrated in FIGS. 16–19. For purposes of the following example, it will be assumed that an image represented by a rectangular matrix of pixels having a horizontal and vertical resolution of 2/d pixels per inch is to be printed using the printer 10. The example will also assume that d is 1/600 inch, resulting in an image resolution of 1200×1200 dpi. With reference to FIG. 16, the pixels in this image matrix are located at intersections of columns C0–C11 and rows R0–R23. For this example, it will again be assumed that the print head 14 has eight nozzles 32*a*–32*d* and 34*a*–34*d*, as shown in FIG. 3.

According to the second embodiment of the invention, a host computer separates the 1200×1200 dpi data into four rectangular arrays of pixels. Each of these four arrays has a horizontal and vertical resolution of 1/d pixels per inch (600×600 dpi). The host computer forms the first of the four arrays to include image pixels located in both the even columns C0–C10 and the even rows R0–R22 of the image matrix. Thus, the first array includes only those pixels located at the intersections of the even columns C0–C10 and the even rows R0–R22.

The first array of pixels is transferred to the printer 10 which prints a first array of dots based on the first array of pixels as shown in FIG. 16. As the carriage 18 and the carriage drive mechanism 22 move the print head 14 horizontally across the print medium (FIG. 2) in a first pass, the nozzles 32*a*–32*d* print dots in the even-numbered rows R0, R4, R8, and R12, and the nozzles 34*a*–34*d* print dots in the even-numbered rows R2, R6, R10, and R14. All of the dots printed during the first pass are disposed in the even-numbered columns C0–C10. Note that there are no non-printing pixels in the first array. Preferably, after printing the first array of dots, the print medium is advanced in the first direction by one quarter of the height of the nozzle array, which in this example is 1/300 inch.

Figure 17:
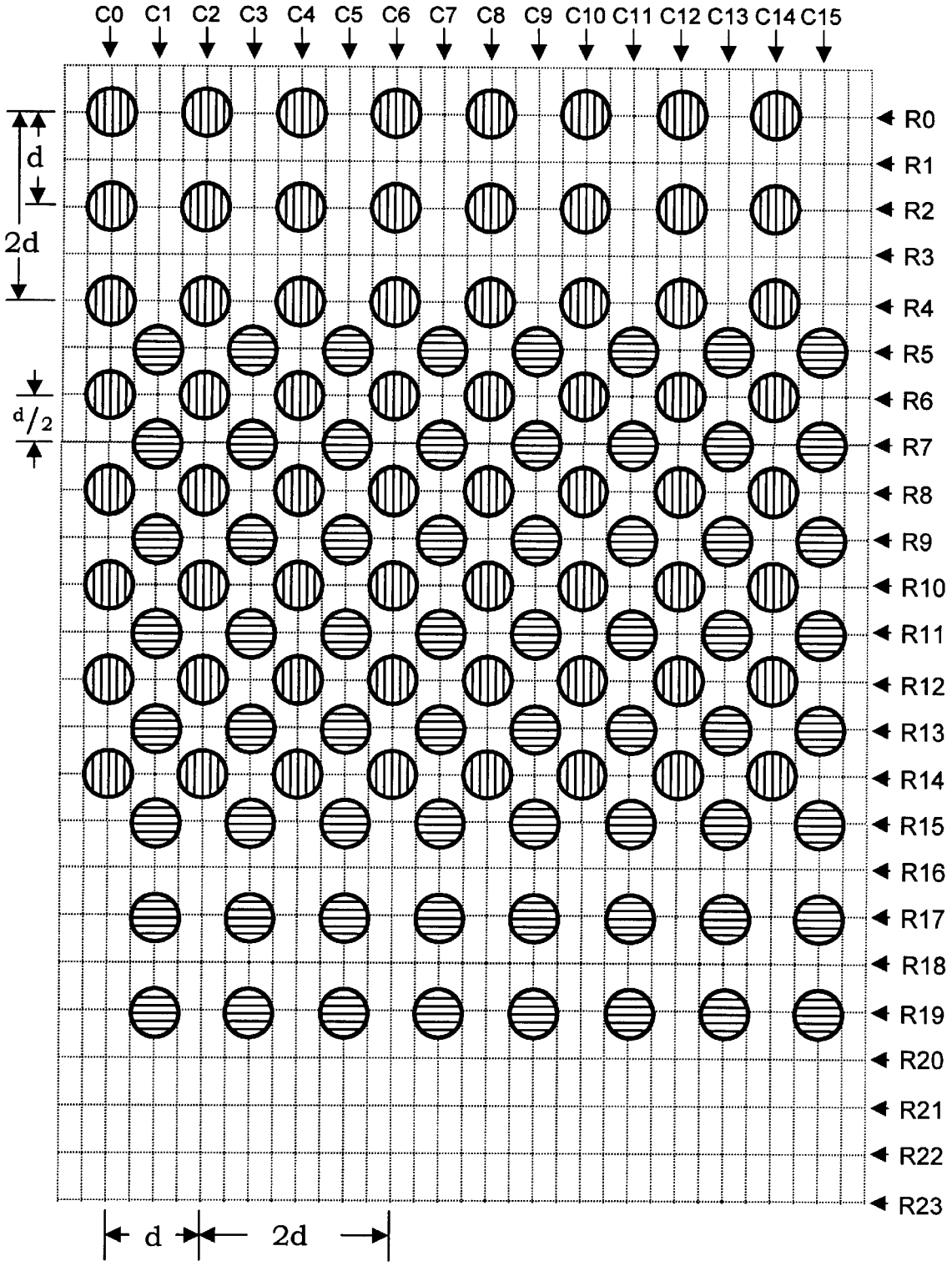
FIG. 17 depicts first and second rectangular patterns of dots printed according to a second embodiment of the invention.

The host computer forms the second of the four arrays to include image pixels located in both the odd columns C1–C11 and the odd rows R1–R23 of the image matrix. Thus, the second array includes only those pixels located at the intersections of the odd columns C1–C11 and the odd rows R1–R23. The second array of pixels is transferred to the printer 10 which prints a second array of dots based on the second array of pixels as shown in FIG. 17. As the print head 14 moves across the print medium in a second pass, the nozzles 32*a*–32*d* print dots in the odd-numbered rows R5, R9, R13, and R17, and the nozzles 34*a*–34*d* print dots in the odd-numbered rows R7, R11, R15, and R19. All of the dots printed during the second pass are disposed in the odd-numbered columns C1–C11. Again, note that there are no non-printing pixels in the second array. Preferably, after printing the second array, the print medium is again advanced in the first direction by 1/300 inch.

Figure 18:
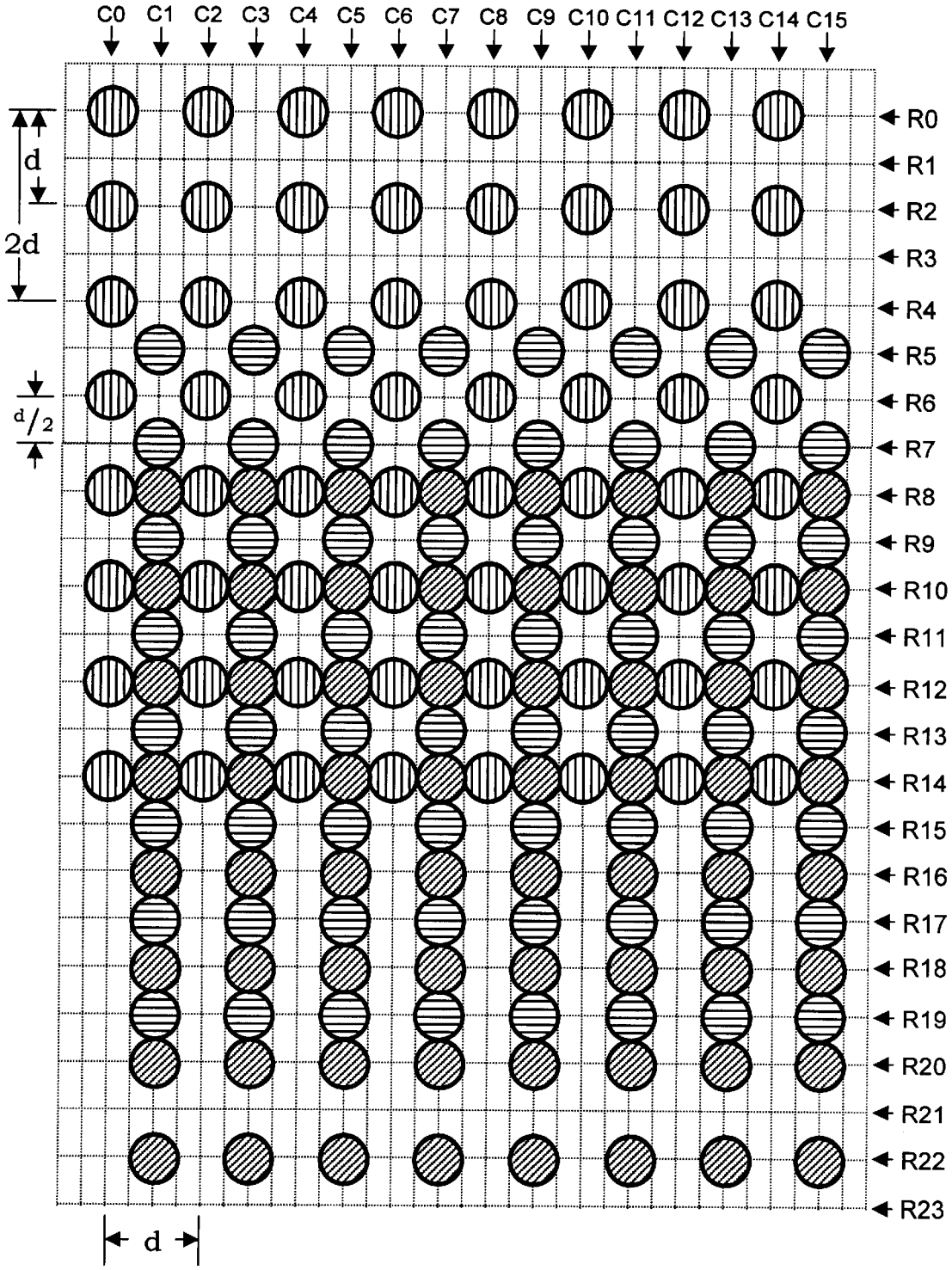
FIG. 18 depicts first, second, and third rectangular patterns of dots printed according to a second embodiment of the invention.

The host computer forms the third array of pixels to include image pixels located in both the odd columns C1–C11 and the even rows R0–R22 of the image matrix. Thus, the third array includes only those pixels located at the intersections of the odd columns C1–C11 and the even rows R0–R22. The third array of pixels is transferred to the printer 10 which prints a third array of dots based on the third array of pixels as shown in FIG. 18. As the print head 14 moves across the print medium in a third pass, the nozzles 32*a*–32*d* print dots in the even-numbered rows R8, R12, R16, and R20, and the nozzles 34*a*–34*d* print dots in the even-numbered rows R10, R14, R18, and R22. All of the dots printed during the third pass are disposed in the odd-numbered columns C1–C11. Preferably, after printing the third array, the print medium is again advanced in the first direction by 1/300 inch.

Figure 19:
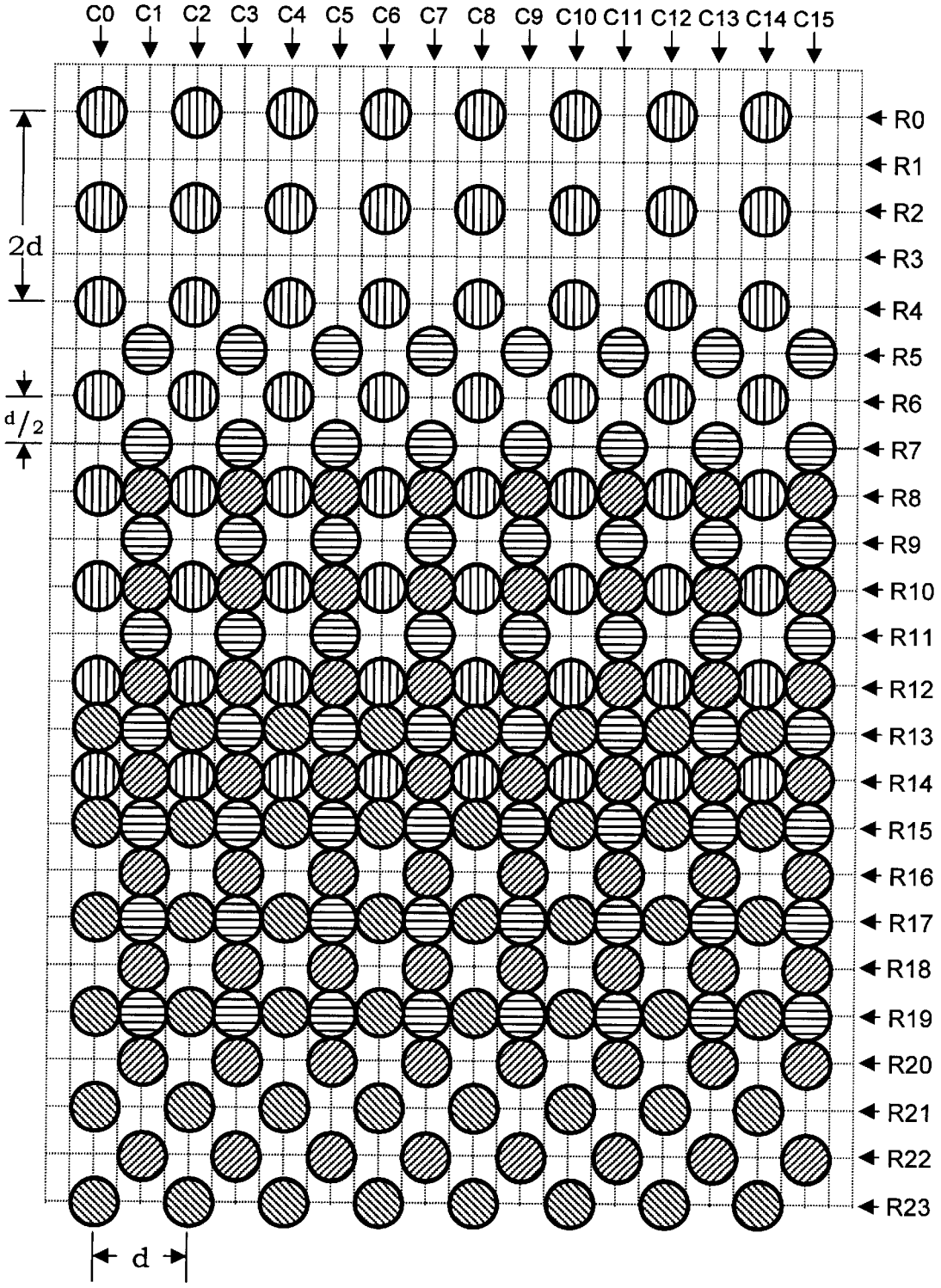
FIG. 19 depicts first, second, third, and fourth rectangular patterns of dots printed according to a second embodiment of the invention.

The host computer forms the fourth array of pixels to include image pixels located in both the even columns C0–C10 and the odd rows R1–R23 of the image matrix. Thus, the fourth array includes only those pixels located at the intersections of the even columns C0–C10 and the odd rows R1–R23. The fourth array of pixels is transferred to the printer 10 which prints a fourth array of dots based on the fourth array of pixels as shown in FIG. 19. As the print head 14 moves across the print medium in a fourth pass, the nozzles 32*a*–32*c* print dots in the odd-numbered rows R13, R17, and R21, and the nozzles 34*a*–34*c* print dots in the odd-numbered rows R15, R19, and R23. Due to limited space in FIG. 19, the dots printed by nozzles 32*d* and 34*d* in the fourth pass are not shown. All of the dots printed during the fourth pass are disposed in the even-numbered columns C0–C10. Preferably, after printing the third array, the print medium is again advanced in the first direction by 1/300 inch.

Comparing the dots depicted in FIG. 15 printed according to the prior method to the dots depicted in FIG. 19 printed according to the second embodiment of the invention, it is apparent that the completed portion of the image (rows R12–R15) after four passes is the same for each method. However, the second embodiment of the invention transfers half as much data from the host to the printer as does the prior method. Thus, the invention avoids the high-resolution data bottleneck that has plagued prior printing systems.

As with the first embodiment of the invention, it should be appreciated that the second embodiment of the invention is not limited by the order in which the four printing passes are made. The adjectives "first", "second", "third", and "fourth" are not intended to indicate any particular temporal order in which the four passes are made to print the four arrays of dots. Thus, the four arrays of dots could be printed in any order to produce the pattern of dots shown in FIG. 19.

To correctly position the carriage 18 and print head 14 relative to an edge of the print medium to begin each of the four passes of the second embodiment, the controller 24 generates drive signals that specify whether the pass is to begin with an even or an odd 1200 dpi column. This horizontal position control could be accomplished in at least two different ways. If the horizontal start position is specified in 1/600 inch intervals, then a drive signal command would specify whether the pass should start at the even column C0 (no offset) or at the odd column C1 (1/1200 inch offset). Alternatively, the horizontal start position could be specified in 1/1200 inch intervals.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An ink jet printer for receiving image data defining a pattern of dots in a rectangular grid and for printing the pattern of dots on a print medium based on the image data, the printer comprising:

a print medium advance mechanism for advancing the print medium in a first direction;

a print head having a plurality of nozzles for ejecting ink droplets onto the print medium to print the dots, the nozzles having a center-to-center spacing in the first direction of d;

a carriage connected to the print head for moving the print head adjacent the print medium in a second direction which is perpendicular to the first direction;

a carriage drive mechanism connected to the carriage for driving the carriage in the second direction; and a printer controller electrically connected to the print head, the print medium advance mechanism, and the carriage drive mechanism, the printer controller for controlling the print head to eject ink droplets from the nozzles toward the print medium, controlling the print medium advance mechanism to advance the print medium in the first direction, and controlling the carriage drive mechanism to move the carriage in the second direction, where the ejection of ink droplets, advancement of the print medium, and movement of the carriage under control of the printer controller forms the pattern of dots on the medium, the pattern of dots consisting of at least four interlaced arrays of dots, each array being offset from the other arrays by a predetermined spacing in at least one of the first and second directions, the printer controller for controlling the print head, the print medium advance mechanism, and the carriage drive mechanism to print the pattern of dots comprising at least four interlaced checkerboard arrays of dots, each of the checkerboard arrays comprising parallel rows of dots aligned in the second direction with a spacing in the second direction between centers of adjacent dots in each row being substantially equivalent to 2d, and each row being offset in the first and second directions from an adjacent row by a distance substantially equivalent to d, where no dot in any of the four arrays overlaps another dot in the same array.

2. The ink jet printer of claim 1 further comprising the printer controller for controlling the print head, the print medium advance mechanism, and the carriage drive mechanism to print the pattern of dots comprising the at least four interlaced checkerboard arrays of dots, each of the checkerboard arrays being offset in the second direction from each other checkerboard array by at least 3/4, and two of the checkerboard arrays being offset in the first direction from the other two checkerboard arrays by an odd nonzero multiple of 1/2.

3. The ink jet printer of claim 1 further comprising the printer controller for controlling the print head, the print medium advance mechanism, and the carriage drive mechanism to print the pattern of dots comprising first, second, third, and fourth checkerboard arrays of dots, the second checkerboard array being offset from the first checkerboard array in the second direction, the third checkerboard array being offset from the second checkerboard array in the first and second directions, and the fourth checkerboard array being offset from the third checkerboard array in the second direction.

4. The ink jet printer of claim 1 further comprising the printer controller for controlling the print head, the print medium advance mechanism, and the carriage drive mechanism to print the pattern of dots comprising first, second, third, and fourth checkerboard arrays of dots, the second checkerboard array being offset from the first checkerboard array in the second direction by a distance substantially equivalent to $^{5d}/_{4}$, the third checkerboard array being offset from the second checkerboard array in the first direction by a distance substantially equivalent to an odd nonzero multiple of $^{d}/_{2}$ and in the second direction by a distance substantially equivalent to $^{-3d}/_{4}$, and the fourth checkerboard array being offset from the third checkerboard array in the second direction by a distance substantially equivalent to $^{-3d}/_{4}$.

5. The ink jet printer of claim 1 further comprising the printer controller for controlling the print head, the print medium advance mechanism, and the carriage drive mechanism to print the pattern of dots comprising first, second, third, and fourth checkerboard arrays of dots, the second checkerboard array being offset from the first checkerboard array in the second direction by a distance substantially equivalent to $^{-3d}/_{4}$, the third checkerboard array being offset from the second checkerboard array in the first direction by a distance substantially equivalent to an odd nonzero multiple of $^{d}/_{2}$ and in the second direction by a distance substantially equivalent to $^{+b\ 5d}/_{4}$, and the fourth checkerboard array being offset from the third checkerboard array in the second direction by a distance substantially equivalent to $^{+b\ 5d}/_{4}$.

6. The ink jet printer of claim 1 further comprising the printer controller for controlling the print head, the print medium advance mechanism, and the carriage drive mechanism to print the pattern of dots comprising the at least four interlaced arrays of dots, each of the arrays comprising parallel columns of dots aligned in the first direction and parallel rows of dots aligned in the second direction, where adjacent dots in each column have a center-to-center spacing in the first direction substantially equivalent to 2d, and where adjacent dots in each row have a center-to-center spacing in the second direction substantially equivalent to 2d.

7. The ink jet printer of claim 6 further comprising the printer controller for controlling the print head, the print medium advance mechanism, and the carriage drive mechanism to print the pattern of dots comprising first, second, third, and fourth interlaced arrays of dots, the second array being offset from the first array in the first and second directions by a distance substantially equivalent to $^{d}/_{2}$, the third array being offset from the second array in the first direction by a distance substantially equivalent to $^{d}/_{2}$, and the fourth array being offset from the third array in the first and second directions by a distance substantially equivalent to $^{d}/_{2}$.

8. A method for ejecting ink droplets onto a print medium to print a pattern of dots which forms a printed image, where the dots have a diameter d, the method comprising the steps of:

ejecting ink droplets to form a first checkerboard array of dots comprising parallel rows of dots, the dots within each row being aligned in a second direction which is perpendicular to a first direction, the dots having a spacing between centers which is substantially equivalent to 2d, each row of dots being offset in the first and second directions from each adjacent row by a distance substantially equivalent to d, where no dot in the first array overlaps another dot in the first array;

ejecting ink droplets to form a second checkerboard array of dots having the same relative spacings between dots as the first checkerboard array, the second checkerboard array being offset from the first checkerboard array in the second direction by a distance less than 2d, where no dot in the second array overlaps another dot in the second array;

ejecting ink droplets to form a third checkerboard array of dots having the same relative spacings between dots as the first checkerboard array, the third checkerboard array being offset from the second checkerboard array in the second direction by a distance less than 2d, and the third checkerboard array being offset from the second checkerboard array in the first direction by a distance less than d, where no dot in the third array overlaps another dot in the third array; and ejecting ink droplets to form a fourth checkerboard array of dots having the same relative spacings between dots as the first checkerboard array, the fourth checkerboard array being offset from the third checkerboard array in the second direction by a distance less than 2d, where no dot in the fourth array overlaps another dot in the fourth array.

9. The method of claim 8 further comprising the steps of ejecting ink droplets to form the first, second, third, and fourth checkerboard array of dots such that each of the checkerboard arrays are offset in the second direction from each other checkerboard array by at least $^{d}/_{4}$, and two of the checkerboard arrays are offset in the first direction from the other two checkerboard arrays by at least an odd nonzero multiple of $^{d}/_{2}$.

10. The method of claim 9 further comprising the step of ejecting ink droplets to form the second checkerboard array of dots being offset from the first checkerboard array in the second direction by a distance substantially equivalent to $^{+b\ 5d}/_{4}$.

11. The method of claim 9 further comprising the step of ejecting ink droplets to form the second checkerboard array of dots being offset from the first checkerboard array in the second direction by a distance substantially equivalent to $^{-3d}/_{4}$.

12. The method of claim 9 further comprising the step of ejecting ink droplets to form the third checkerboard array of dots being offset from the second checkerboard array in the first direction by a distance substantially equivalent to an odd nonzero multiple of $^{d}/_{2}$ and in the second direction by a distance substantially equivalent to $^{-3d}/_{4}$.

13. The method of claim 9 further comprising the step of ejecting ink droplets to form the third checkerboard array of dots being offset from the second checkerboard array in the first direction by a distance substantially equivalent to an odd nonzero multiple of $^{d}/_{2}$ and in the second direction by a distance substantially equivalent to $^{5d}/_{4}$.

14. The method of claim 9 further comprising the step of ejecting ink droplets to form the fourth checkerboard array of dots being offset from the third checkerboard array in the second direction by a distance substantially equivalent to $^{-3d}/_{4}$.

15. The method of claim 9 further comprising the step of ejecting ink droplets to form the fourth checkerboard array of dots being offset from the third checkerboard array in the second direction by a distance substantially equivalent to $^{5d}/_{4}$.

16. A method for ejecting ink droplets from an array of ink jet nozzles onto a print medium to print a pattern of dots which forms a printed image, where the nozzles are aligned in a first direction and have a center-to-center spacing in the first direction of d, the method comprising the steps of:

ejecting ink droplets to form a first array of dots comprising parallel columns of dots aligned in the first direction and parallel rows of dots aligned in a second direction which is orthogonal to the first direction, where adjacent dots in each column have a center-to-center spacing in the first direction substantially equivalent to 2d, where adjacent dots in each row have a center-to-center spacing in the second direction substantially equivalent to 2d, and where no dot in the first array overlaps another dot in the first array;

ejecting ink droplets to form a second array of dots having the same relative spacings between dots as the first array, the second array being offset from the first array in the first and second directions by a distance substantially equivalent to $d/2$, where no dot in the second array overlaps another dot in the second array;

ejecting ink droplets to form a third array of dots having the same relative spacings between dots as the first array, the third array being offset from the second array in the first direction by a distance substantially equivalent to $d/2$, where no dot in the third array overlaps another dot in the third array; and ejecting ink droplets to form a fourth array of dots having the same relative spacings between dots as the first array, the fourth array being offset from the third array in the first and second directions by a distance substantially equivalent to $d/2$, where no dot in the fourth array overlaps another dot in the fourth array.

17. A method for formatting image data representing an image to be printed by ejecting ink droplets from an array of ink jet nozzles in an ink jet print head, where the nozzles are aligned in a first direction and have a center-to-center spacing in the first direction of d, the method comprising the steps of:

receiving image data represented by a rectangular matrix of pixels, the matrix having a resolution of substantially equivalent to $2/d$ pixels per unit length in the first direction and $2/d$ pixels per unit length in a second direction which is orthogonal to the first direction, the matrix of pixels comprising alternating even and odd columns and alternating even and odd rows of pixels; and separating the image data into four arrays of pixels, each array having a resolution of substantially equivalent to $1/d$ pixels per unit length in the first direction and $1/d$ pixels per unit length in the second direction, the separating comprising the steps of:

forming a first array of pixels comprising pixels disposed in both the even columns and the even rows of the matrix of pixels;

forming a second array of pixels comprising pixels disposed in both the odd columns and the odd rows of the matrix of pixels;

forming a third array of pixels comprising pixels disposed in both the odd columns and the even rows of the matrix of pixels; and forming a fourth array of pixels comprising pixels disposed in both the even columns and the odd rows of the matrix of pixels.

18. The method of claim 17 further comprising:

transferring the first array of pixels to the print head;

ejecting ink droplets onto a print medium to form a first array of dots corresponding to the first array of pixels, the first array of dots comprising parallel columns of dots aligned in the first direction and parallel rows of dots aligned in the second direction, where adjacent dots in each column have a center-to-center spacing in the first direction substantially equivalent to d, and where adjacent dots in each row have a center-to-center spacing in the second direction substantially equivalent to d;

transferring the second array of pixels to the print head;

ejecting ink droplets onto the print medium to form a second array of dots corresponding to the second array of pixels, the second array of dots having the same relative spacings between dots as the first array of dots, the second array of dots being offset from the first array of dots in the first and second directions by a distance substantially equivalent to $d/2$;

transferring the third array of pixels to the print head;

ejecting ink droplets onto the print medium to form a third array of dots corresponding to the third array of pixels, the third array of dots having the same relative spacings between dots as the first array of dots, the third array of dots being offset from the second array of dots in the first direction by a distance substantially equivalent to $d/2$;

transferring the fourth array of pixels to the print head; and ejecting ink droplets onto the print medium to form a fourth array of dots corresponding to the fourth array of pixels, the fourth array of dots having the same relative spacings between dots as the first array of dots, the fourth array of dots being offset from the third array of dots in the first and second directions by a distance substantially equivalent to $d/2$.

* * * * *